US011460803B2

(12) United States Patent
Sato et al.

(10) Patent No.: US 11,460,803 B2
(45) **Date of Patent: *Oct. 4, 2022**

(54) PROCESS CARTRIDGE

(71) Applicant: BROTHER KOGYO KABUSHIKI KAISHA, Nagoya (JP)

(72) Inventors: Shougo Sato, Seto (JP); Hideshi Nishiyama, Owariasahi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/199,527

(22) Filed: Mar. 12, 2021

(65) Prior Publication Data

US 2021/0271202 A1 Sep. 2, 2021

Related U.S. Application Data

(63) Continuation of application No. 16/739,563, filed on Jan. 10, 2020, now Pat. No. 10,962,924, which is a (Continued)

(30) Foreign Application Priority Data

Sep. 30, 2016 (JP) ..... 2016-194663

(51) Int. Cl.
*G03G 21/18* (2006.01)
*G03G 21/10* (2006.01)
*G03G 21/12* (2006.01)

(52) U.S. Cl.
CPC ..... *G03G 21/1814* (2013.01); *G03G 21/105* (2013.01); *G03G 21/12* (2013.01); *G03G 21/1821* (2013.01); *G03G 21/1842* (2013.01)

(58) Field of Classification Search
CPC ..... G03G 21/1814; G03G 21/105; G03G 21/12; G03G 21/1821; G03G 21/1842; G03G 2221/1853
See application file for complete search history.

(56) References Cited

U.S. PATENT DOCUMENTS 4,849,791 A 7/1989 Hagihara et al.
5,128,724 A 7/1992 Hayashi et al.
(Continued)

FOREIGN PATENT DOCUMENTS

JP 7-271162 A 10/1995
JP 8-62966 A 3/1996
(Continued)

OTHER PUBLICATIONS

Office Action issued in related Japanese Patent Application 2016-073467, dated Jan. 21, 2020.
(Continued)

*Primary Examiner* — Sandra Brase
(74) *Attorney, Agent, or Firm* — Merchant & Gould P.C.

(57) ABSTRACT

A developing roller and a photosensitive drum are aligned in a second direction different from a first direction. A toner storage portion stores toner to be supplied to the photosensitive drum by the developing roller. A waste-toner storage portion stores toner conveyed through a conveyance pipe. The waste-toner storage portion has a main portion and a protruding portion protruding from the main portion in the first direction. A drum cartridge has a guide portion configured to guide the protruding portion of the waste-toner storage portion when a developing cartridge is being mounted on the drum cartridge. The guide portion includes first and second guides. The first guide extends in a third direction different from the first and second directions. The second guide continues from the first guide and is located
(Continued)

closer to the photosensitive drum than the first guide is. The second guide extends in the second direction.

16 Claims, 15 Drawing Sheets

Related U.S. Application Data continuation of application No. 16/276,890, filed on Feb. 15, 2019, now Pat. No. 10,678,183, which is a continuation of application No. 15/655,550, filed on Jul. 20, 2017, now Pat. No. 10,248,078.

(56) References Cited

U.S. PATENT DOCUMENTS

| | | | |
|---|---|---|---|
| 5,614,996 | A | 3/1997 | Tanda |
| 5,835,822 | A | 11/1998 | Nagasaki et al. |
| 6,339,689 | B1 | 1/2002 | Sugiura |
| 8,275,285 | B2 | 9/2012 | Kawakami et al. |
| 10,248,078 | B2 | 4/2019 | Sato |
| 10,962,924 | B2 * | 3/2021 | Sato ..... G03G 21/1814 |
| 2003/0039484 | A1 | 2/2003 | Saito et al. |
| 2012/0039622 | A1 | 2/2012 | Cho |
| 2012/0128391 | A1 | 5/2012 | Ushikubo |
| 2013/0259532 | A1 | 10/2013 | Kubota et al. |
| 2013/0266347 | A1 | 10/2013 | Kubota et al. |
| 2014/0205321 | A1 | 7/2014 | Jang et al. |
| 2015/0050044 | A1 | 2/2015 | Sato |
| 2015/0277368 | A1 | 10/2015 | Nishiyama et al. |
| 2015/0355595 | A1 | 12/2015 | Jang et al. |
| 2016/0109827 | A1 | 4/2016 | Yoshida et al. |

FOREIGN PATENT DOCUMENTS

| | | | |
|---|---|---|---|
| JP | 2000-231313 | A | 8/2000 |
| JP | 2001-94271 | A | 4/2001 |
| JP | 2001-235933 | A | 8/2001 |
| JP | 2003-66815 | A | 3/2003 |
| JP | 2003-107828 | A | 4/2003 |
| JP | 2011-17939 | A | 1/2011 |
| JP | 2011-197197 | A | 10/2011 |
| JP | 2013-160795 | A | 8/2013 |
| JP | 2014-232270 | A | 12/2014 |

OTHER PUBLICATIONS

Office Action issued in related Japanese Patent Application 2016-073471, dated Jan. 21, 2020.

Office Action issued in corresponding Japanese Patent Application No. 2016-194663, dated Sep. 29, 2020.

* cited by examiner

PROCESS CARTRIDGE

CROSS REFERENCE TO RELATED APPLICATIONS

This application is a continuation of U.S. patent application Ser. No. 16/739,563, filed Jan. 10, 2020, now U.S. Pat. No. 10,962,924, which is a continuation of U.S. patent application Ser. No. 16/276,890, filed Feb. 15, 2019, now U.S. Pat. No. 10,678,183, which is a continuation of U.S. patent application Ser. No. 15/655,550, filed Jul. 20, 2017, now U.S. Pat. No. 10,248,078, which claims priority from Japanese Patent Application No. 2016-194663 filed Sep. 30, 2016. The entire content of these applications is incorporated herein by reference.

TECHNICAL FIELD

This specification relates to a process cartridge.

BACKGROUND

Conventionally, a process cartridge is mounted on an image forming apparatus. For example, the process cartridge includes a photosensitive drum and a developing cartridge. The developing cartridge includes a developing roller. The process cartridge further includes a waste-toner storage portion. The waste-toner storage portion stores toner which is removed from the surface of the photosensitive drum.

SUMMARY

According to one aspect, this specification discloses a process cartridge. The process cartridge includes a drum cartridge and a developing cartridge. The drum cartridge includes a photosensitive drum, a cleaner, and a conveyance pipe. The photosensitive drum is rotatable about a first axis extending in a first direction. The photosensitive drum has a circumferential surface. The cleaner is configured to remove toner from the circumferential surface of the photosensitive drum. The conveyance pipe is for conveying toner removed by the cleaner. The developing cartridge is detachably mounted on the drum cartridge. The developing cartridge includes a developing roller, a toner storage portion, and a waste-toner storage portion. The developing roller is rotatable about a second axis extending in the first direction. The developing roller is adjacent to the photosensitive drum in a state where the developing cartridge is mounted on the drum cartridge. The developing roller and the photosensitive drum are aligned in a second direction different from the first direction in a state where the developing cartridge is mounted on the drum cartridge. The toner storage portion is configured to store toner to be supplied to the photosensitive drum by the developing roller. The waste-toner storage portion is configured to store toner conveyed through the conveyance pipe. The waste-toner storage portion has a main portion and a protruding portion protruding from the main portion in the first direction. The drum cartridge has a guide portion configured to guide the protruding portion of the waste-toner storage portion when the developing cartridge is being mounted on the drum cartridge. The guide portion includes a first guide and a second guide. The first guide extends in a third direction different from the first direction and the second direction. The second guide continues from the first guide. The second guide is located closer to the photosensitive drum than the first guide is. The second guide extends in the second direction.

According to another aspect, this specification also discloses a process cartridge. The process cartridge includes a drum cartridge, a waste-toner storage cartridge, and a developing cartridge. The drum cartridge includes a photosensitive drum, a cleaner, and a conveyance member. The photosensitive drum is rotatable about a first axis extending in a first direction. The photosensitive drum has a circumferential surface. The cleaner is configured to remove toner from the circumferential surface of the photosensitive drum. The conveyance member is provided in a conveyance pipe and is configured to convey toner removed by the cleaner. The waste-toner storage cartridge is configured to store toner conveyed through the conveyance pipe. The waste-toner storage cartridge has a main portion, a protruding portion protruding from the main portion of the waste-toner storage cartridge in the first direction, and a boss protruding from a surface of the waste-toner storage cartridge in the first direction. The developing cartridge is detachably mounted on the drum cartridge. The developing cartridge includes a developing roller and a holding portion. The developing roller is rotatable about a second axis extending in the first direction. The developing roller is adjacent to the photosensitive drum in a state where the developing cartridge is mounted on the drum cartridge. The developing roller and the photosensitive drum are aligned in a second direction different from the first direction in a state where the developing cartridge is mounted on the drum cartridge. The holding portion includes a hole. The boss is inserted through the hole. The drum cartridge has a guide portion configured to guide the protruding portion of the waste-toner storage cartridge when the developing cartridge is being mounted on the drum cartridge. The guide portion includes a first guide and a second guide. The first guide extends in a third direction different from the first direction and the second direction. The second guide continues from the first guide. The second guide is located closer to the photosensitive drum than the first guide is. The second guide extends in the second direction.

According to still another aspect, this specification also discloses a process cartridge. The process cartridge includes a drum cartridge and a developing cartridge. The drum cartridge includes a photosensitive drum, a cleaner, and a conveyance member. The photosensitive drum is rotatable about a first axis extending in a first direction. The photosensitive drum has a circumferential surface. The cleaner is configured to remove toner from the circumferential surface of the photosensitive drum. The conveyance member is provided in a conveyance pipe and is configured to convey toner removed by the cleaner. The developing cartridge is detachably mounted on the drum cartridge. The developing cartridge includes a casing, a developing roller, and a wall. The casing has a space therein. The developing roller is provided at the casing and is rotatable about a second axis extending in the first direction. The developing roller is adjacent to the photosensitive drum in a state where the developing cartridge is mounted on the drum cartridge. The developing roller and the photosensitive drum are aligned in a second direction different from the first direction in a state where the developing cartridge is mounted on the drum cartridge. The wall partitions the space in the casing into a toner storage chamber and a waste-toner storage chamber. The toner storage chamber is configured to store toner to be supplied to the photosensitive drum by the developing roller. The waste-toner storage chamber is configured to store toner conveyed through the conveyance pipe. The casing and the wall defining the waste-toner storage chamber serve as a main portion of a waste-toner storage portion. The waste-toner storage portion has the main portion and a protruding portion protruding from the main portion in the first direction. The drum cartridge has a guide portion configured to guide the protruding portion of the waste-toner storage portion when the developing cartridge is being mounted on the drum cartridge. The guide portion includes a first guide and a second guide. The first guide extends in a third direction different from the first direction and the second direction. The second guide continues from the first guide. The second guide is located closer to the photosensitive drum than the first guide is. The second guide extends in the second direction.

BRIEF DESCRIPTION OF THE DRAWINGS

Embodiments in accordance with this disclosure will be described in detail with reference to the following figures wherein.

DETAILED DESCRIPTION

In the above-mentioned process cartridge, there is a demand for maximizing the amount of toner stored within the developing cartridge.

Here, in order to maximize the amount of toner stored within the developing cartridge, it is necessary to increase the capacity of the waste-toner storage portion due to the increase in the amount of toner stored within the developing cartridge.

However, it is likely that a space near the photosensitive drum is restricted, so that it is difficult to increase the capacity of the waste-toner storage portion. For example, in the process cartridge, in a state where the process cartridge is mounted on the image forming apparatus, the waste-toner storage portion is located between the photosensitive drum and a fixing unit. Hence, with consideration given to the prevention of interference with the fixing unit, the space near the photosensitive drum is restricted, and thus it is difficult to maximize the amount of toner stored within the developing cartridge without increasing the capacity of the waste-toner storage portion.

In view of the foregoing, an example of an object of this specification is to disclose a process cartridge which maximizes the amount of toner stored within a developing cartridge without increasing the capacity of a waste-toner storage portion.

An aspect of this disclosure will be described while referring to the accompanying drawings.

First Embodiment

1. Outline of Process Cartridge

An outline of a process cartridge 1 of a first embodiment will be described with reference to FIGS. 1 and 2.

Figure 1:
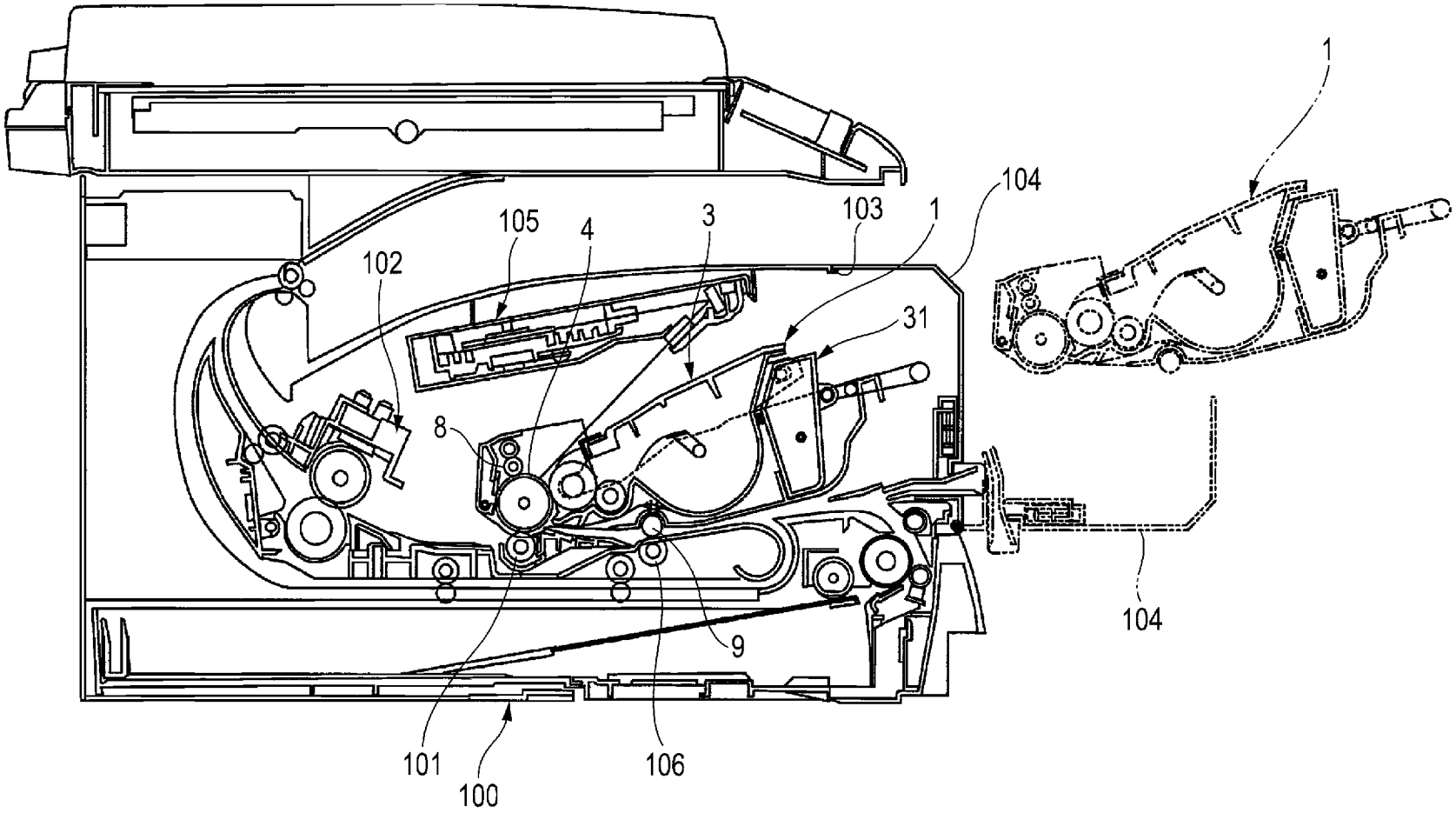
FIG. 1 is a schematic configuration diagram of an image forming apparatus.

As shown in FIG. 1, the process cartridge 1 is detachably mounted on an image forming apparatus 100 in a state where a cover 104 is opened. The cover 104 is provided so as to close an opening 103 in the side surface of the image forming apparatus 100. The process cartridge 1 is configured such that in a state where the process cartridge 1 is mounted on the image forming apparatus 100, a toner image is formed on the surface of a photosensitive drum 4. The image forming apparatus 100 includes an exposure unit 105, a transfer roller 101 and a fixing unit 102. The exposure unit 105 is configured to expose the surface of the photosensitive drum 4. The transfer roller 101 is configured to transfer the toner image formed on the circumferential surface of the photosensitive drum 4 to a sheet. The transfer roller 101 is in contact with the circumferential surface of the photosensitive drum 4. The fixing unit 102 is configured to heat and pressurize the sheet to which the toner image is transferred and thereby fix the toner image to the sheet. As shown in FIG. 2, the process cartridge 1 includes a drum cartridge 2 and a developing cartridge 3.

1.1 Drum Cartridge

The drum cartridge 2 includes a charging roller 8, the photosensitive drum 4 and a sheet conveyance roller 9.

The charging roller 8 is configured to charge the surface of the photosensitive drum 4. The charging roller 8 is in contact with the surface of the photosensitive drum 4.

The photosensitive drum 4 is rotatable about a first axis A1 extending in a first direction. The photosensitive drum 4 extends along the first axis A1. The first axis A1 is an imaginary axis. More specifically, the first axis A1 is an imaginary axis which extends along a direction in which the photosensitive drum 4 extends. On the surface of the photosensitive drum 4, an electrostatic latent image is formed. Specifically, the surface of the photosensitive drum 4 which is uniformly charged by the charging roller 8 is exposed by the exposure unit 105 (see FIG. 1), and thereby the electrostatic latent image is formed on the surface of the photosensitive drum 4. The photosensitive drum 4 is spaced away from the fixing unit 102 (see FIG. 1) in a state where the process cartridge 1 is mounted on the image forming apparatus 100.

The sheet conveyance roller 9 is rotatable about an axis extending in the first direction. The sheet conveyance roller 9 is a driven roller, forms a pair with a drive roller 106 (see FIG. 1) which is provided in the image forming apparatus 100 and conveys the sheet.

1.2 Developing Cartridge

The developing cartridge 3 is configured to supply the toner to the photosensitive drum 4 and to thereby develop the electrostatic latent image on the circumferential surface of the photosensitive drum 4. In a state where the process cartridge 1 is mounted on the image forming apparatus 100, the developing cartridge 3 is located on an opposite side from the fixing unit 102 (see FIG. 1) with respect to the photosensitive drum 4. The developing cartridge 3 is detachable on the drum cartridge 2. The developing cartridge 3 includes a developing roller 5, a frame 6 and a supply roller 10.

The developing roller 5 is rotatable about a second axis A2 extending in the first direction. In a state where the developing cartridge 3 is mounted on the drum cartridge 2, the developing roller 5 is adjacent to the photosensitive drum 4. The developing roller 5 extends along the second axis A2. The second axis A2 is an imaginary axis. More specifically, the second axis A2 is an imaginary axis which extends along a direction in which the developing roller 5 extends.

The frame 6 includes a toner storage chamber 7. The toner storage chamber 7 is an example of a toner storage portion. In other words, the developing cartridge 3 includes the toner storage chamber 7. In a state where the developing cartridge 3 is mounted on the drum cartridge 2, the toner storage chamber 7 is located on an opposite side from the photosensitive drum 4 with respect to the developing roller 5 in a second direction. The second direction is a direction directed from the developing roller 5 to the photosensitive drum 4. That is, the developing roller 5 and the photosensitive drum 4 are aligned in the second direction. More specifically, the rotational axis of the developing roller 5 (the second axis A2) and the rotational axis of the photosensitive drum 4 (the first axis A1) are aligned in the second direction. The second direction intersects the first direction. Preferably, the second direction perpendicularly intersects the first direction. The toner storage chamber 7 stores toner therein. The toner within the toner storage chamber 7 is supplied by the developing roller 5 to the photosensitive drum 4.

The supply roller 10 is in contact with the developing roller 5 so as to be rotatable. The supply roller 10 supplies the toner to the developing roller 5.

2. Details of Drum Cartridge

The details of the drum cartridge 2 will be described with reference to FIGS. 2 to 5.

Figure 2:
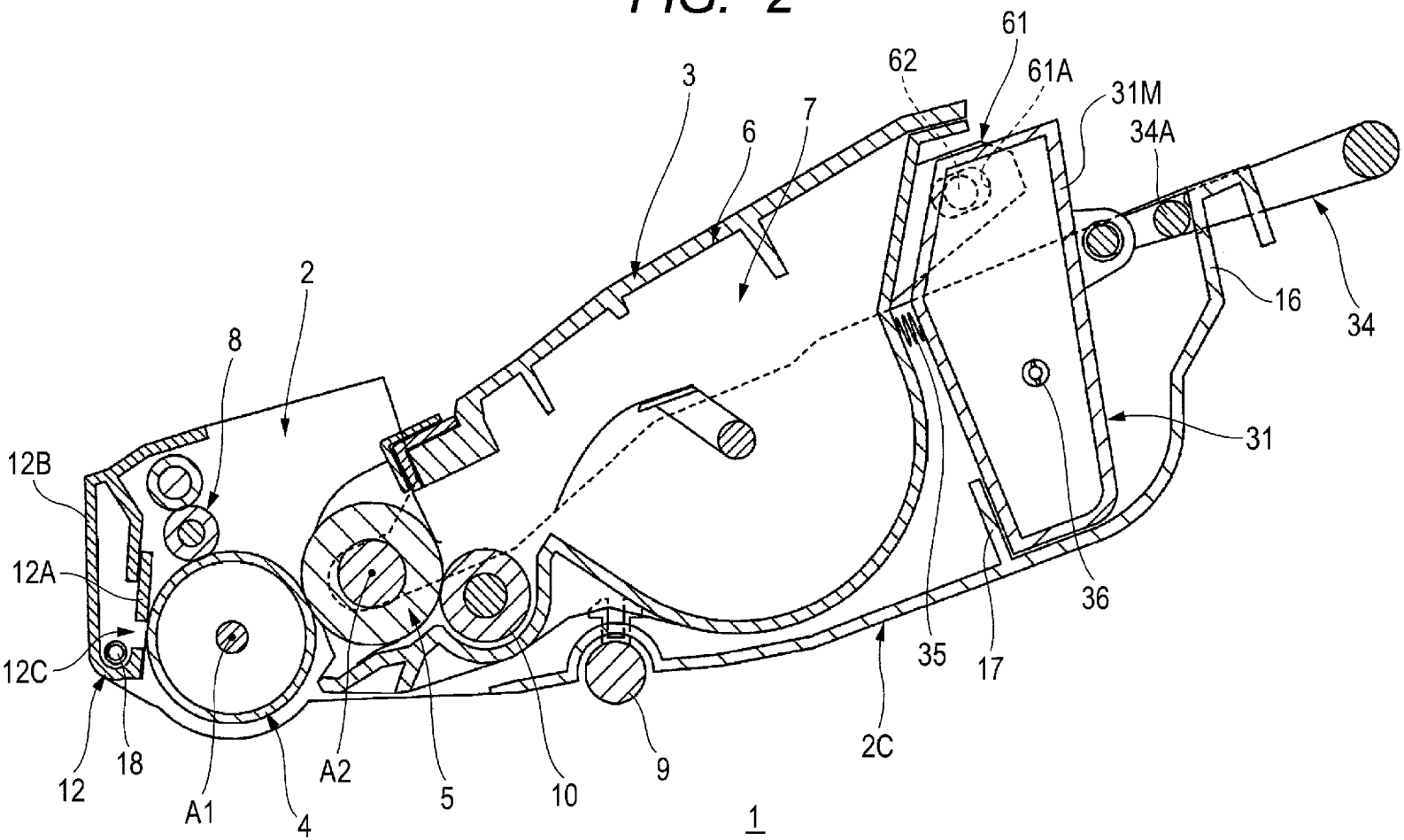
FIG. 2 is a schematic configuration diagram of a process cartridge of a first embodiment.
Figure 3:
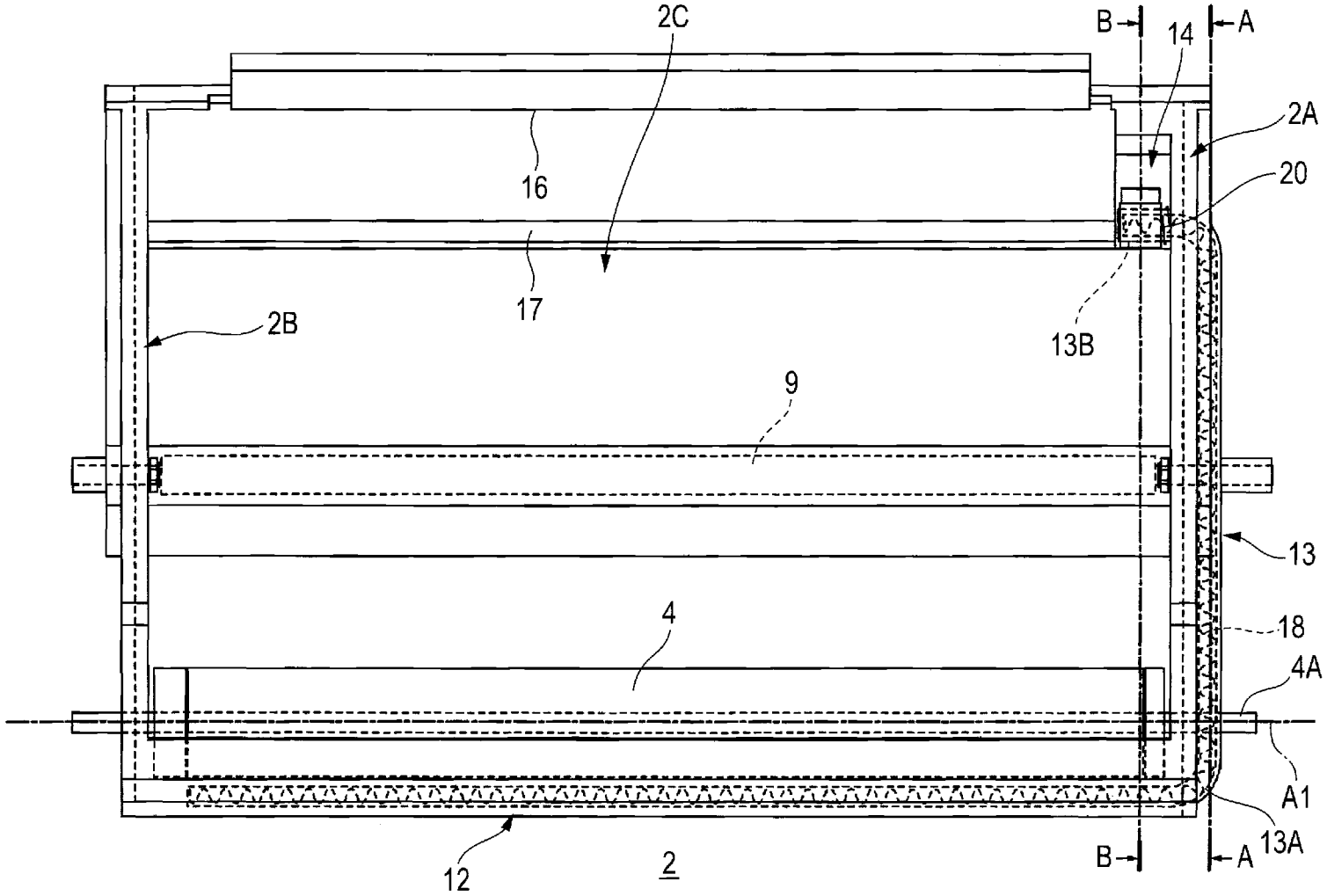
FIG. 3 is a plan view of a drum cartridge shown in FIG. 2.

As shown in FIGS. 2 and 3, the drum cartridge 2 is formed in the shape of a tray. Specifically, the drum cartridge 2 includes a first wall 2A, a second wall 2B and a connection wall 2C.

The first wall 2A and the second wall 2B are spaced away from each other in the first direction. The first wall 2A and the second wall 2B individually extend in the second direction in a state where the developing cartridge 3 is mounted on the drum cartridge 2. The photosensitive drum 4 is located between the first wall 2A and the second wall 2B in the first direction. The photosensitive drum 4 is supported through a shaft 4A by the first wall 2A and the second wall 2B. The shaft 4A extends along the first axis A1.

The connection wall 2C is located between the first wall 2A and the second wall 2B in the first direction. The connection wall 2C extends in the first direction. One end of the connection wall 2C in the first direction is connected to the first wall 2A. The other end of the connection wall 2C in the first direction is connected to the second wall 2B.

The drum cartridge 2 further includes a cleaner 12, a conveyance pipe 13, a guide portion 14 (see FIG. 5), a roller guide portion 15 (see FIG. 5), a first contact portion 16 and a second contact portion 17.

2.1 Cleaner

As shown in FIG. 2, the cleaner 12 is configured to remove the toner from the circumferential surface of the photosensitive drum 4 and to store the removed toner therein. In a state where the developing cartridge 3 is mounted on the drum cartridge 2, the cleaner 12 is located on an opposite side from the developing cartridge 3 with respect to the photosensitive drum 4 in the second direction. Specifically, the cleaner 12 includes a cleaning member 12A and a cleaner frame 12B.

The cleaning member 12A is a member for removing the toner from the circumferential surface of the photosensitive drum 4. The cleaning member 12A is formed in the shape of a plate. The cleaning member 12A extends in the first direction. The cleaning member 12A is attached to the cleaner frame 12B. The edge of the cleaning member 12A is in contact with the circumferential surface of the photosensitive drum 4. In this way, the cleaning member 12A removes the toner from the circumferential surface of the photosensitive drum 4 when the photosensitive drum 4 rotates.

The cleaner frame 12B is configured to store therein the toner removed by the cleaning member 12A. The cleaner frame 12B extends in the first direction. The cleaner frame 12B includes an opening 12C. The opening 12C faces the edge of the cleaning member 12A. The opening 12C extends in the first direction. The toner removed by the cleaning member 12A is stored, through the opening 12C, within the cleaner frame 12B.

2.2 Conveyance Pipe

Figure 4:
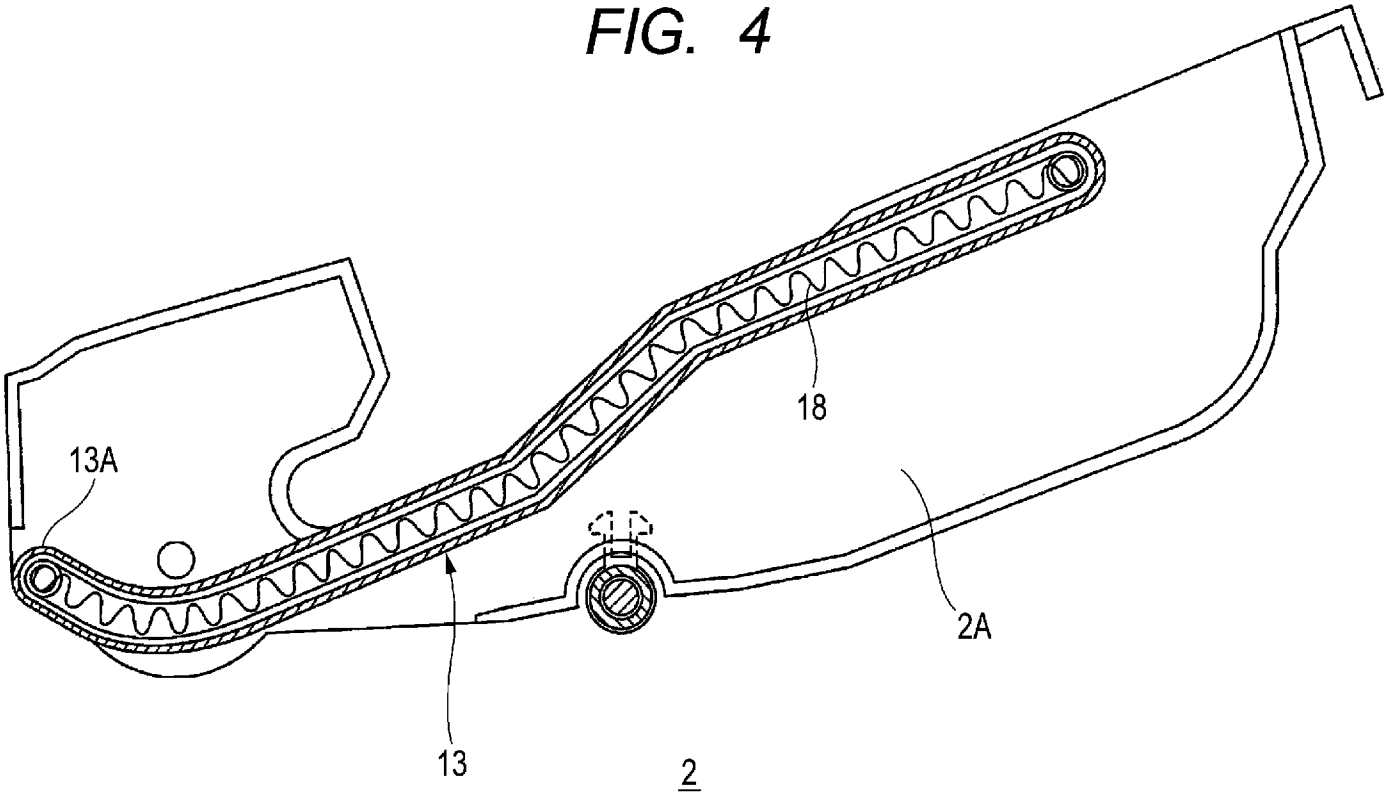
FIG. 4 is a cross-sectional view taken along line A-A of FIG. 3.

As shown in FIGS. 3 and 4, the conveyance pipe 13 is a pipe for conveying the toner removed by the cleaner 12.

Specifically, the conveyance pipe 13 is attached to the first wall 2A. The conveyance pipe 13 is located on an opposite side from the second wall 2B with respect to the first wall 2A in the first direction. In other words, the conveyance pipe 13 is located outside the first wall 2A. In this way, in a state where the developing cartridge 3 is mounted on the drum cartridge 2, the conveyance pipe 13 is located on an opposite side from the toner storage chamber 7 with respect to the first wall 2A in the first direction.

The conveyance pipe 13 extends in the second direction along the outer surface of the first wall 2A. One end portion 13A of the conveyance pipe 13 in the second direction is connected to the cleaner 12. The other end portion 13B of the conveyance pipe 13 in the second direction is located between the first wall 2A and the second wall 2B in the first direction. In other words, the other end portion 13B is located inside the first wall 2A. Specifically, the other end portion 13B is located on the inner surface of the first wall 2A. In a state where the developing cartridge 3 is mounted on the drum cartridge 2, the other end portion 13B is located between an outer surface 31A of a waste-toner storage cartridge 31 described later and the first wall 2A in the first direction. The waste-toner storage cartridge 31 is an example of a waste-toner storage portion. In a state where the developing cartridge 3 is mounted on the drum cartridge 2, the other end portion 13B is connected to the waste-toner storage cartridge 31 described later (see FIG. 9). The other end portion 13B extends in the first direction. The other end portion 13B is formed in the shape of a cylinder.

Within the conveyance pipe 13 and within the cleaner 12, a conveyance member 18 is provided. In other words, the drum cartridge 2 further includes the conveyance member 18. The conveyance member 18 is configured to convey the toner. Specifically, the conveyance member 18 extends in the first direction within the cleaner 12, and extends in the second direction within the conveyance pipe 13. The conveyance member 18 is formed in the shape of a spiral. When the process cartridge 1 is mounted on the image forming apparatus 100 (see FIG. 1), and an image forming operation is performed, the conveyance member 18 is rotated to convey the toner within the cleaner 12 toward the conveyance pipe 13 and to convey the toner within the conveyance pipe 13 toward the waste-toner storage cartridge 31. In this way, the toner which is removed by the cleaner 12 and is stored within the cleaner 12 is conveyed toward the waste-toner storage cartridge 31 within the conveyance pipe 13.

Figure 5:
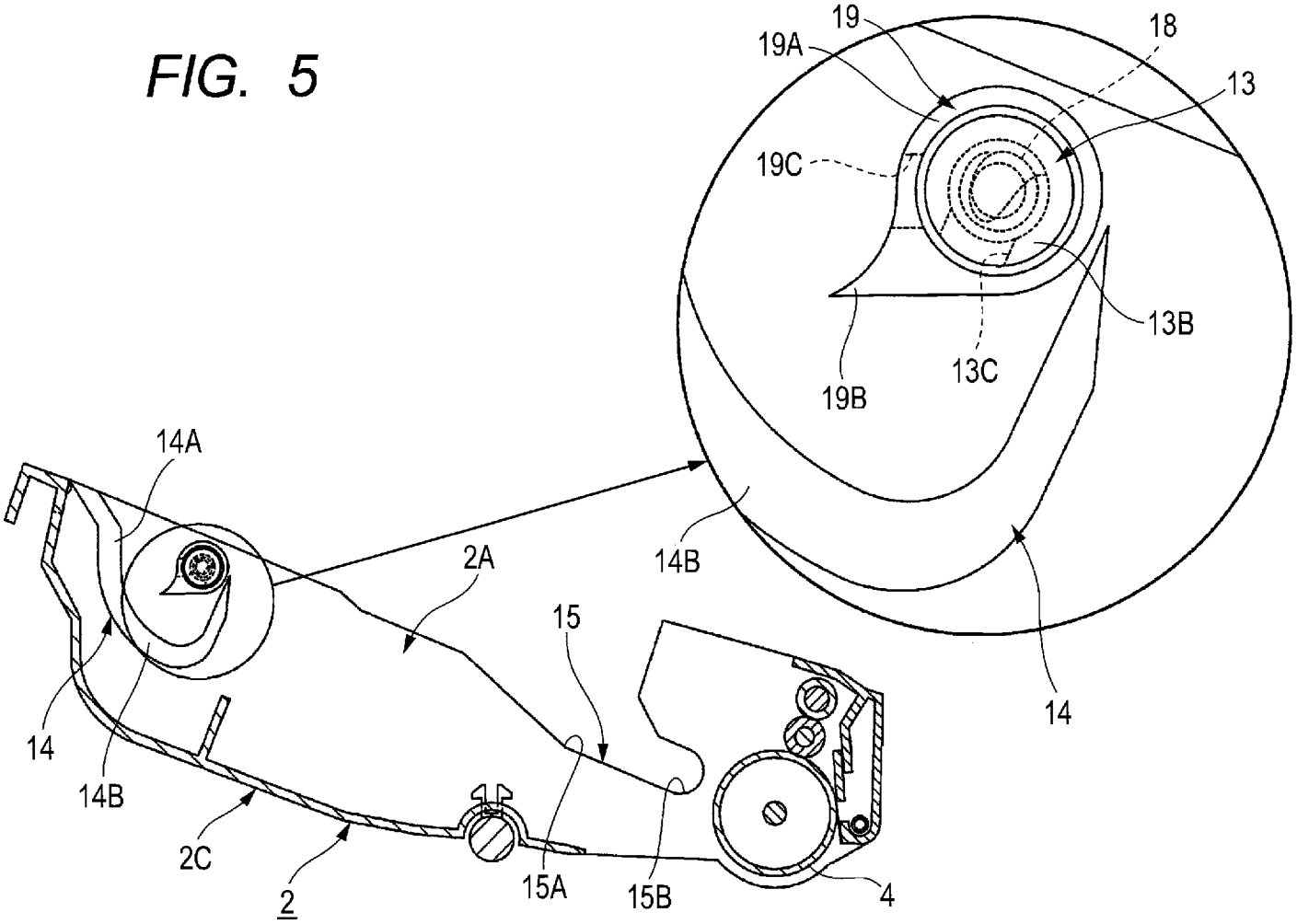
FIG. 5 is a cross-sectional view taken along line B-B of FIG. 3.

As shown in FIG. 5, the conveyance pipe 13 includes a discharge port 13C. The conveyance pipe 13 also includes a first shutter 19. In other words, the drum cartridge 2 includes the first shutter 19.

The discharge port 13C is an opening for discharging, from the conveyance pipe 13, the toner conveyed within the conveyance pipe 13. The discharge port 13C is located at the other end portion 13B of the conveyance pipe 13. In a state where the process cartridge 1 is mounted on the image forming apparatus 100, the discharge port 13C is located below the conveyance member 18.

The first shutter 19 can be moved between a close position (see FIG. 5) which closes the discharge port 13C and an open position (see FIG. 9) which opens the discharge port 13C. Specifically, the first shutter 19 is attached to the other end portion 13B of the conveyance pipe 13. The first shutter 19 covers the circumferential surface of the other end portion 13B. (In FIG. 5, a space is shown between the first shutter 19 and the other end portion 13B but, in an actual product, the first shutter 19 is in contact with the other end portion 13B.) The first shutter 19 can be rotated about the other end portion 13B between the open position and the close position. The first shutter 19 is urged by a spring 20 toward the close position. In this way, when the developing cartridge 3 is separated from the drum cartridge 2, the first shutter 19 is located in the close position. The first shutter 19 includes a main body portion 19A and a first protrusion 19B.

The main body portion 19A is a portion which covers the circumferential surface of the conveyance pipe 13. The main body portion 19A extends in the first direction. The main body portion 19A is formed in the shape of a cylinder. The main body portion 19A includes a first shutter opening 19C. In other words, the first shutter 19 includes the first shutter opening 19C. The first shutter opening 19C is provided in the circumferential surface of the main body portion 19A. When the first shutter 19 is located in the open position, at least part of the first shutter opening 19C overlaps the discharge port 13C. When the first shutter 19 is located in the close position, the first shutter opening 19C does not overlap the discharge port 13C.

The first protrusion 19B is a protrusion which is in contact with a main body portion 33A (see FIG. 8) of a second shutter 33 described later when the developing cartridge 3 is being mounted on the drum cartridge 2. The first protrusion 19B protrudes from the circumferential surface of the main body portion 19A in a radial direction of the main body portion 19A.

Figure 8:
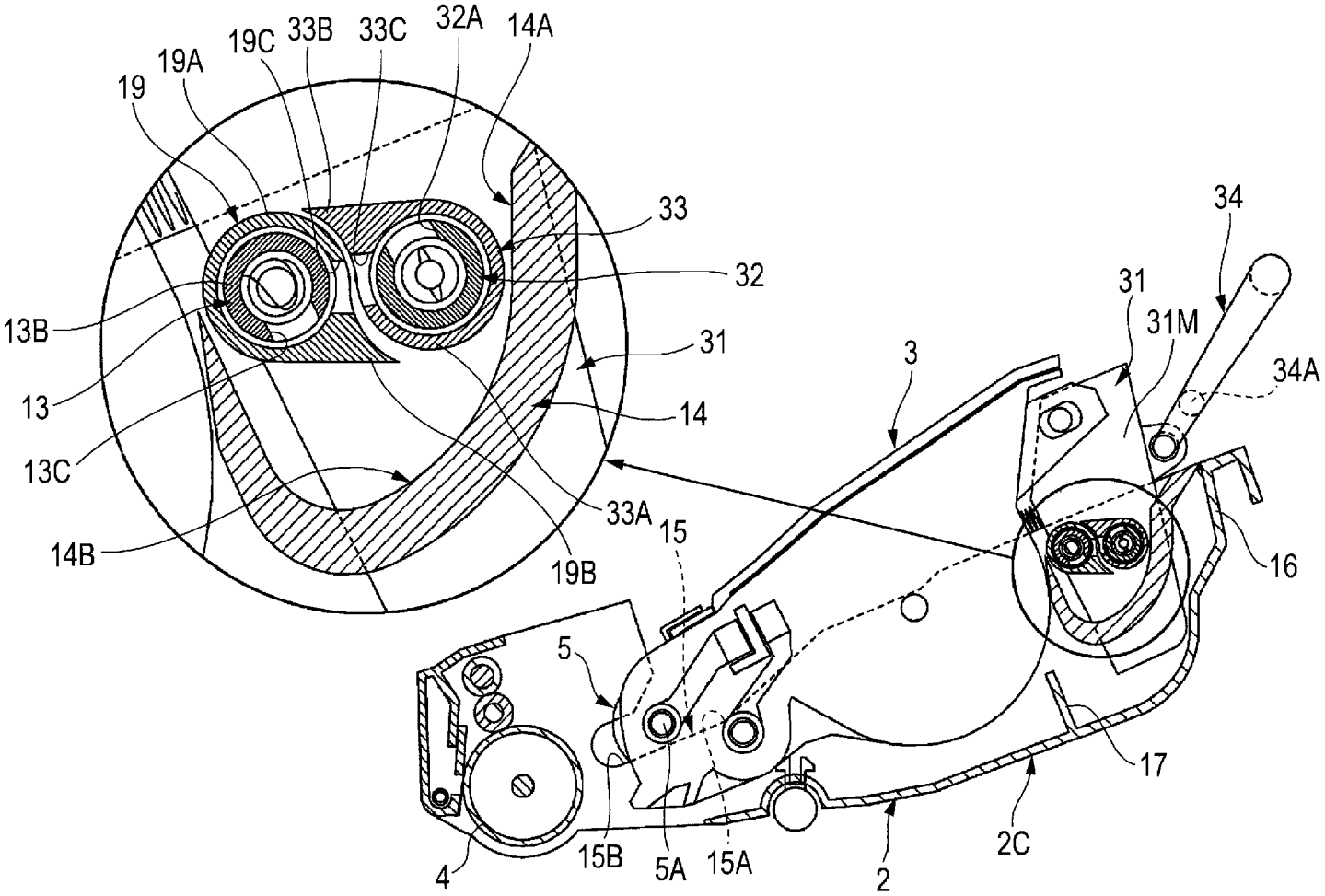
FIG. 8 is an illustrative diagram for illustrating the mounting of the developing cartridge on the drum cartridge in the first embodiment, and shows a state where a protruding portion of a waste-toner storage portion is guided by a first guide.

As shown in FIG. 8, when the developing cartridge 3 is being mounted on the drum cartridge 2, if a protruding portion 32 of the waste-toner storage cartridge 31 described later is located between the other end portion 13B of the conveyance pipe 13 and a first guide 14A described later, the first protrusion 19B makes contact with the main body portion 33A of the second shutter 33. Here, the first shutter opening 19C overlaps a second shutter opening 33C described later. In other words, in a state where the first protrusion 19B is in contact with the second shutter 33, the first shutter opening 19C and the second shutter opening 33C overlap each other. In other words, the first shutter opening 19C and the second shutter opening 33C communicate with each other.

Figure 9:
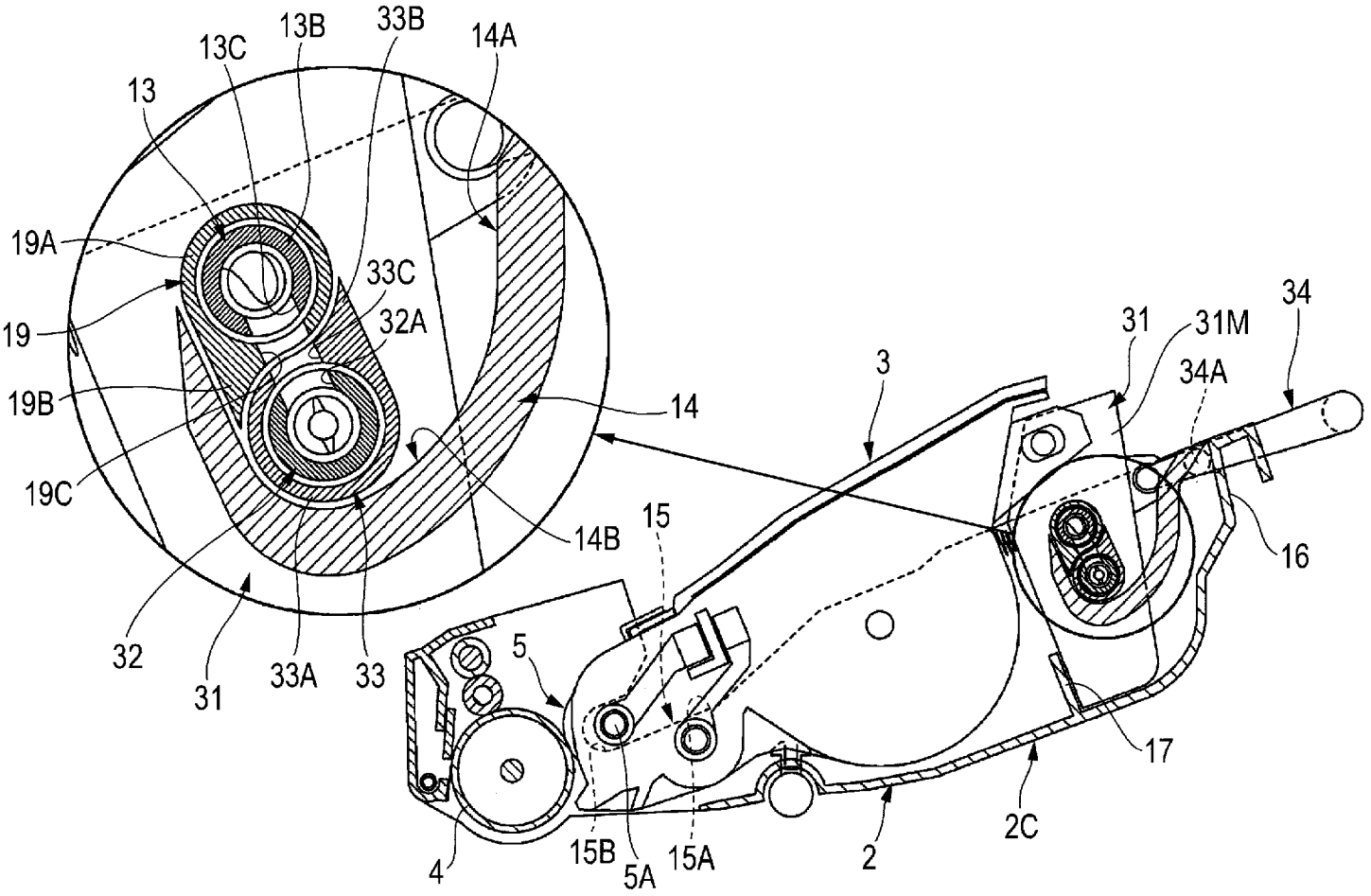
FIG. 9 is an illustrative diagram for illustrating the mounting of the developing cartridge on the drum cartridge following FIG. 8, and shows a state where the mounting of the developing cartridge on the drum cartridge is completed.

Then, as shown in FIG. 9, when the developing cartridge 3 is being mounted on the drum cartridge 2, in a state where the first shutter 19 is in contact with part of the developing cartridge 3, the first shutter 19 moves from the close position to the open position. Specifically, when the developing cartridge 3 is being mounted on the drum cartridge 2, in a state where the first protrusion 19B is in contact with the main body portion 33A of the second shutter 33, the first shutter 19 moves from the close position to the open position. When the developing cartridge 3 is being mounted on the drum cartridge 2, in a state where the first shutter 19 is in contact with the part of the developing cartridge 3, the protruding portion 32 is guided by the guide portion 14, and thereby the first shutter 19 moves from the close position to the open position. Specifically, when the developing cartridge 3 is being mounted on the drum cartridge 2, the protruding portion 32 described later is guided by a second guide 14B described later in a direction toward the photosensitive drum 4 in the second direction. Then, the first protrusion 19B is pressed by the main body portion 33A of the second shutter 33. In this way, the first shutter 19 moves from the close position to the open position. The first shutter 19 is located in the open position in a state where the developing cartridge 3 is mounted on the drum cartridge 2.

2.3 Guide Portion

The guide portion 14 is a portion for guiding the protruding portion 32 (see FIG. 8) of the waste-toner storage cartridge 31 when the developing cartridge 3 is being mounted on the drum cartridge 2. As shown in FIGS. 3 and 5, the guide portion 14 is provided on the inner surface of the first wall 2A. The guide portion 14 protrudes from the inner surface of the first wall 2A in the first direction. The guide portion 14 extends in the rotating direction of the first shutter 19. The guide portion 14 includes the first guide 14A and the second guide 14B.

The first guide 14A is located on an opposite side from the photosensitive drum 4 with respect to the other end portion 13B of the conveyance pipe 13 in the second direction. In other words, the first guide 14A is located on an opposite side from the photosensitive drum 4 with respect to the discharge port 13C in the second direction. The first guide 14A is spaced away from the other end portion 13B of the conveyance pipe 13 and the first shutter 19 in the second direction. The first guide 14A extends in a third direction which is different from the second direction. The third direction intersects the first direction and the second direction. Preferably, the third direction perpendicularly intersects the first direction, and intersects the second direction.

The second guide 14B is located between the other end portion 13B of the conveyance pipe 13 and the connection wall 2C in the third direction. The second guide 14B is aligned with the discharge port 13C in the third direction. The second guide 14B is spaced away from the other end portion 13B of the conveyance pipe 13 and the first shutter 19 in the third direction. The second guide 14B is located between the first guide 14A and the connection wall 2C in the third direction. In other words, the second guide 14B is located closer to the connection wall 2C than the first guide 14A is in the third direction. The second guide 14B is located closer to the photosensitive drum 4 than the first guide 14A is in the second direction. The second guide 14B is continuous with the first guide 14A. The second guide 14B extends in the second direction. The second guide 14B is curved. Specifically, the second guide 14B is curved from a direction toward the connection wall 2C in the third direction to a direction toward the photosensitive drum 4 in the second direction. In this way, as shown in FIGS. 8 and 9, when the developing cartridge 3 is being mounted on the drum cartridge 2, the protruding portion 32 of the waste-toner storage cartridge 31 is first guided by the first guide 14A in a direction toward the connection wall 2C in the third direction. Then, the protruding portion 32 of the waste-toner storage cartridge 31 is guided by the second guide 14B in a direction toward the photosensitive drum 4 in the second direction. Specifically, the protruding portion 32 of the waste-toner storage cartridge 31 is guided by the second guide 14B in a direction toward the photosensitive drum 4 in the second direction while the protruding portion 32 is being turned from the direction toward the connection wall 2C in the third direction to the direction toward the photosensitive drum 4 in the second direction.

2.4 Roller Guide Portion

As shown in FIG. 5, when the developing cartridge 3 is being mounted on the drum cartridge 2, the roller guide portion 15 guides a shaft 5A (see FIG. 6) of the developing roller 5 in a direction toward the photosensitive drum 4 in the second direction. The shaft 5A extends in the first direction. In the first direction, the shaft 5A has one end portion and the other end portion. The roller guide portion 15 is provided in each of the first wall 2A and the second wall 2B. When the developing cartridge 3 is being mounted on the drum cartridge 2, the roller guide portion 15 of the first wall 2A guides the one end portion of the shaft 5A in the first direction. When the developing cartridge 3 is being mounted on the drum cartridge 2, the roller guide portion 15 of the second wall 2B guides the other end portion of the shaft 5A in the first direction. The roller guide portion 15 is located between the photosensitive drum 4 and the guide portion 14 in the second direction. The roller guide portion 15 extends in the second direction. In the second direction, the roller guide portion 15 has one end portion 15A and the other end portion 15B. The other end portion 15B is spaced away from the one end portion 15A in the second direction. The other end portion 15B is located closer to the photosensitive drum 4 than the one end portion 15A is in the second direction.

As shown in FIG. 8, when the developing cartridge 3 is being mounted on the drum cartridge 2 and the protruding portion 32 of the waste-toner storage cartridge 31 is located between the other end portion 13B of the conveyance pipe 13 and the first guide 14A, the shaft 5A of the developing roller 5 is in contact with the roller guide portion 15 between the one end portion 15A and the other end portion 15B. In other words, when the protruding portion 32 is guided by the guide portion 14 in the third direction, the shaft 5A makes contact with the roller guide portion 15 between the one end portion 15A and the other end portion 15B. Note that, in the state shown in FIG. 8, a reception port 32A (described later) of the protruding portion 32 is located between the discharge port 13C and the first guide 14A. That is, when the developing cartridge 3 is being mounted on the drum cartridge 2, the reception port 32A moves down through a side of the discharge port 13C opposite from the photosensitive drum 4.

Then, as shown in FIG. 9, when the developing cartridge 3 is being mounted on the drum cartridge 2, as the protruding portion 32 of the waste-toner storage cartridge 31 is guided by the second guide 14B in a direction toward the photosensitive drum 4 in the second direction, the shaft 5A of the developing roller 5 is guided by the roller guide portion 15 in a direction toward the photosensitive drum 4 in the second direction. In other words, when the protruding portion 32 is guided by the guide portion 14 in a direction toward the photosensitive drum 4 in the second direction, the shaft 5A is guided by the roller guide portion 15 in a direction toward the photosensitive drum 4 in the second direction.

2.5 First Contact Portion and Second Contact Portion

As shown in FIG. 2, the first contact portion 16 and the second contact portion 17 are portions for positioning the waste-toner storage cartridge 31 with respect to the drum cartridge 2.

In a state where the developing cartridge 3 is mounted on the drum cartridge 2, the first contact portion 16 is configured to make contact with the waste-toner storage cartridge 31 in the second direction. In a state where the developing cartridge 3 is mounted on the drum cartridge 2, the first contact portion 16 is located on an opposite side from the photosensitive drum 4 with respect to the waste-toner storage cartridge 31 in the second direction. Specifically, in a state where the developing cartridge 3 is mounted on the drum cartridge 2, the first contact portion 16 is configured to make contact with the support shaft 34A of a handle 34 described later in the second direction.

In a state where the developing cartridge 3 is mounted on the drum cartridge 2, the second contact portion 17 is configured to make contact with the waste-toner storage cartridge 31 in the second direction. In a state where the developing cartridge 3 is mounted on the drum cartridge 2, the second contact portion 17 is located between the waste-toner storage cartridge 31 and the photosensitive drum 4 in the second direction. Specifically, in a state where the developing cartridge 3 is mounted on the drum cartridge 2, the second contact portion 17 is located between the waste-toner storage cartridge 31 and the toner storage chamber 7 in the second direction. The second contact portion 17 extends in the third direction. The second contact portion 17 is formed in the shape of a plate. The second contact portion 17 extends from the connection wall 2C.

In a state where the developing cartridge 3 is mounted on the drum cartridge 2, the waste-toner storage cartridge 31 is in contact with the first contact portion 16 and the second contact portion 17 so as to be positioned with respect to the drum cartridge 2 in the second direction.

3. Details of Developing Cartridge

The details of the developing cartridge 3 will be described with reference to FIGS. 6 and 7.

Figure 6:
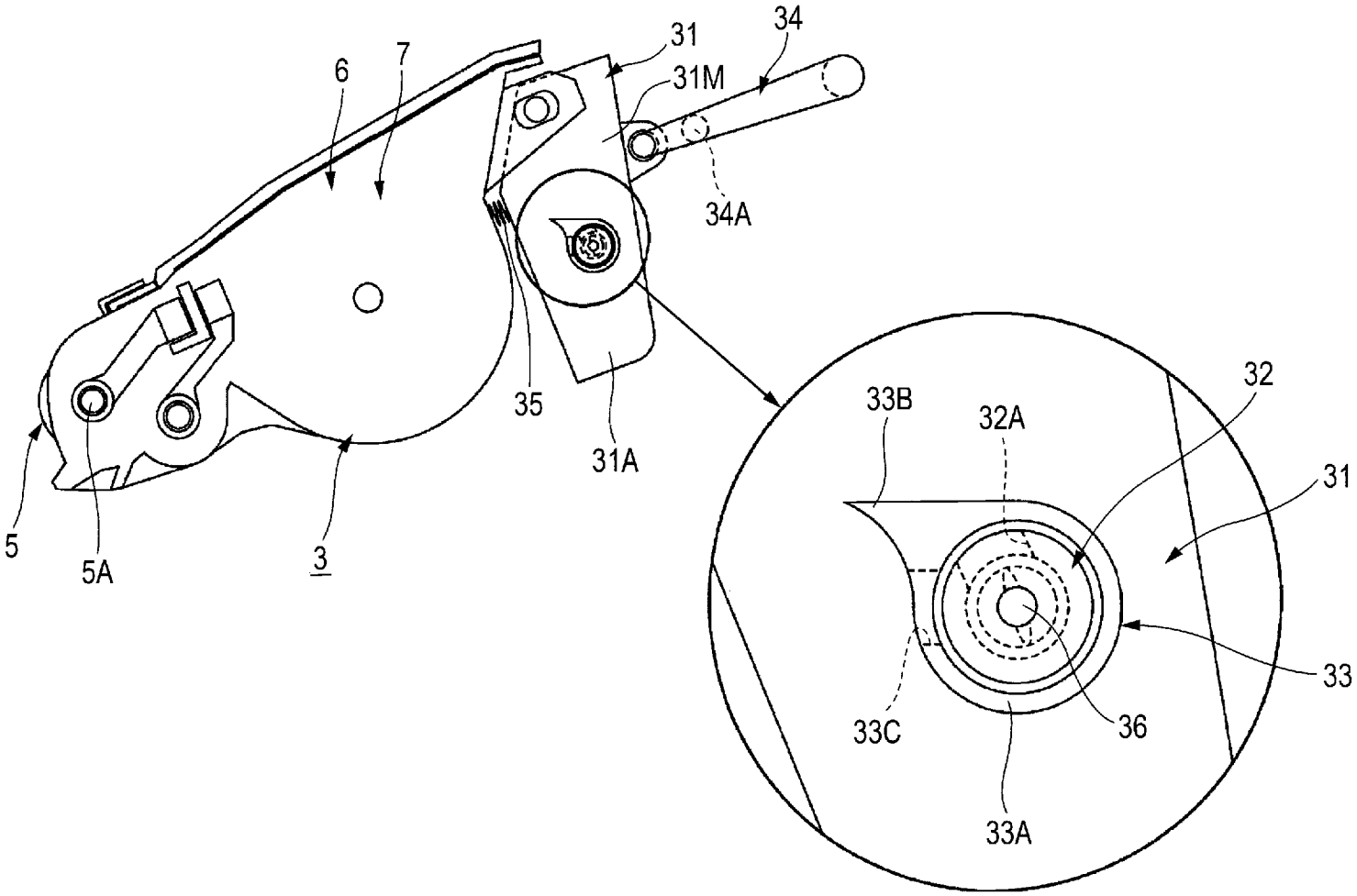
FIG. 6 is a side view of a developing cartridge shown in FIG. 2.
Figure 7:
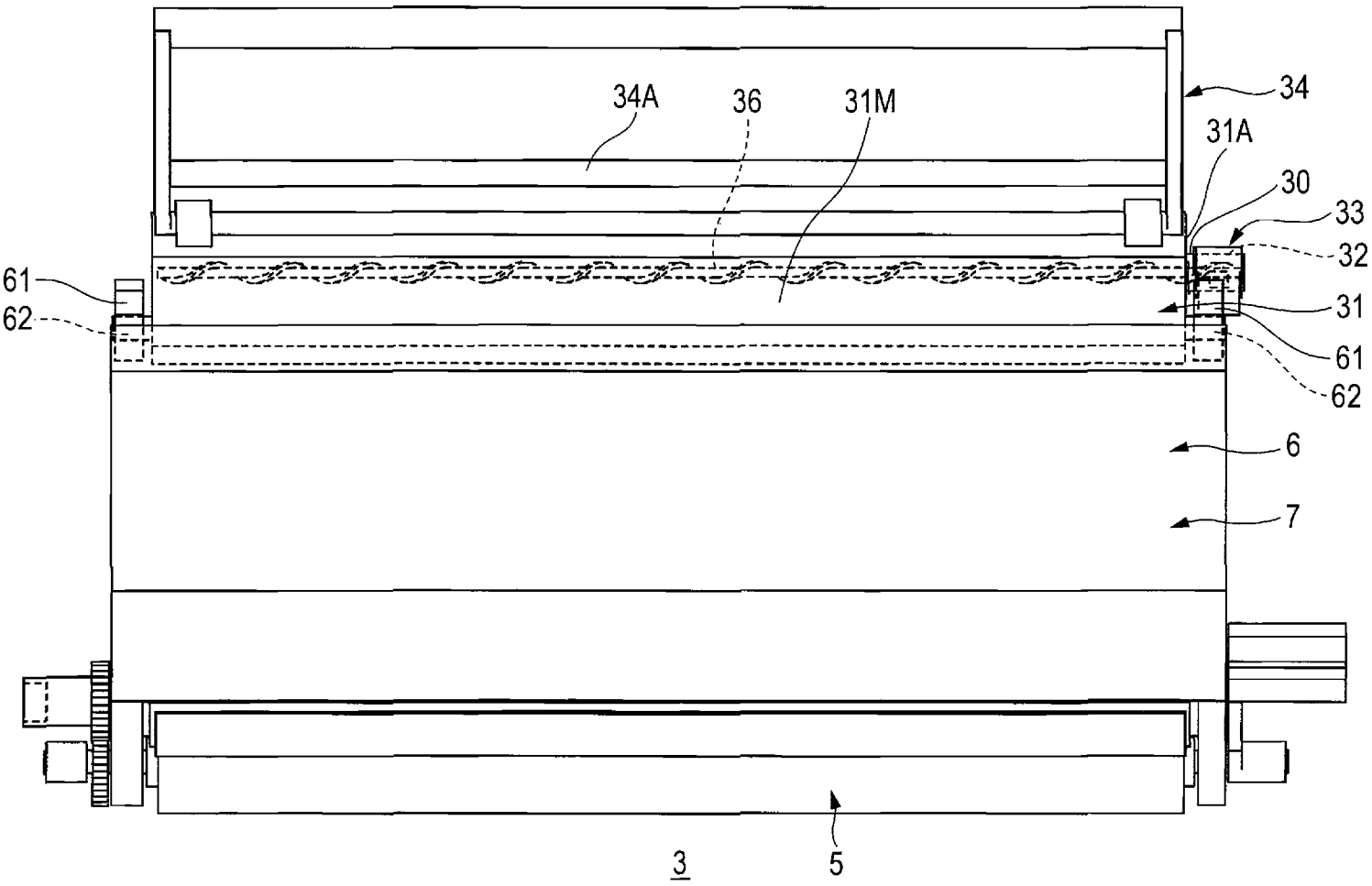
FIG. 7 is a plan view of the developing cartridge shown in FIG. 6.

As shown in FIGS. 6 and 7, the developing cartridge 3 further includes the waste-toner storage cartridge 31.

3.1 Waste-Toner Storage Cartridge

The waste-toner storage cartridge 31 has a main portion 31M, the protruding portion 32, an auger 36 and the handle 34. The main portion 31M has a space therein and stores the toner conveyed through the conveyance pipe 13 (see FIG. 3). In other words, the main portion 31M stores the toner removed by the cleaner 12 from the circumferential surface of the photosensitive drum 4. The waste-toner storage cartridge 31 is located on an opposite side from the developing roller 5 with respect to the toner storage chamber 7 in the second direction. In other words, as shown in FIG. 2, in a state where the developing cartridge 3 is mounted on the drum cartridge 2, the waste-toner storage cartridge 31 is located on an opposite side from the photosensitive drum 4 with respect to the toner storage chamber 7 in the second direction. As shown in FIG. 1, in a state where the process cartridge 1 is mounted on the image forming apparatus 100, the waste-toner storage cartridge 31 is located on an opposite side from the fixing unit 102 with respect to the photosensitive drum 4. As shown in FIGS. 6 and 7, the waste-toner storage cartridge 31 is attached to the toner storage chamber 7 of the frame 6. The waste-toner storage cartridge 31 can be moved in the second direction with respect to the toner storage chamber 7. Specifically, as shown in FIG. 2, the developing cartridge 3 includes two holding portions 61. The two holding portions 61 are spaced away from each other in the first direction. Since the two holding portions 61 have the same shape and function, in the following discussion, one of the two holding portions 61 will be described. The holding portion 61 is a portion for holding the waste-toner storage cartridge 31. The holding portion 61 extends from the frame 6 in a direction away from the developing roller 5 in the second direction. The holding portion 61 is formed substantially in the shape of a pentagon. The holding portion 61 overlaps the waste-toner storage cartridge 31 in the first direction. The holding portion 61 includes an elongated hole 61A. The elongated hole 61A extends in the second direction. The waste-toner storage cartridge 31 includes a boss 62 which protrudes in the first direction. The boss 62 is formed in the shape of a cylinder. The boss 62 is inserted through the elongated hole 61A. In this way, the waste-toner storage cartridge 31 can be moved, relative to the toner storage chamber 7, in a direction in which the elongated hole 61A extends (that is, in the second direction). A spring 35 (an urging member) is provided between the toner storage chamber 7 and the waste-toner storage cartridge 31 in the second direction. The waste-toner storage cartridge 31 is urged by the spring 35 in a direction away from the toner storage chamber 7 in the second direction. The toner storage chamber 7 is urged by the spring 35 in a direction away from the waste-toner storage cartridge 31 in the second direction, and the developing roller 5 is pressed against the photosensitive drum 4 in a state where the developing cartridge 3 is mounted on the drum cartridge 2.

3.1.1 Protruding Portion

The protruding portion 32 is located on the outer surface 31A of the waste-toner storage cartridge 31 in the first direction. In a state where the developing cartridge 3 is mounted on the drum cartridge 2, the outer surface 31A faces the first wall 2A (see FIG. 3) in the first direction. In a state where the developing cartridge 3 is mounted on the drum cartridge 2, the outer surface 31A is spaced away from the first wall 2A in the first direction. The protruding portion 32 protrudes from the outer surface 31A in the first direction. In a state where the developing cartridge 3 is mounted on the drum cartridge 2, the protruding portion 32 is located between the outer surface 31A and the first wall 2A in the first direction. The protruding portion 32 is formed in the shape of a cylinder. The protruding portion 32 includes the reception port 32A. The protruding portion 32 includes the second shutter 33. In other words, the developing cartridge 3 includes the second shutter 33.

The reception port 32A is an opening for receiving the toner conveyed within the conveyance pipe 13 into the waste-toner storage cartridge 31 in a state where the developing cartridge 3 is mounted on the drum cartridge 2. In a state where the process cartridge 1 is mounted on the image forming apparatus 100, the reception port 32A is located below the discharge port 13C (see FIG. 9) of the conveyance pipe 13.

The second shutter 33 can be moved between a close position (see FIG. 6) which closes the reception port 32A and an open position (see FIG. 9) which opens the reception port 32A. Specifically, the second shutter 33 is attached to the protruding portion 32. The second shutter 33 covers the circumferential surface of the protruding portion 32. The second shutter 33 can be rotated about the protruding portion 32 between the open position and the close position. The second shutter 33 is urged by a spring 30 toward the close position. In this way, when the second shutter 33 is separated from the drum cartridge 2, the second shutter 33 is located in the close position. The second shutter 33 includes the main body portion 33A and a second protrusion 33B.

The main body portion 33A is a portion which covers the circumferential surface of the protruding portion 32. The main body portion 33A extends in the first direction. The main body portion 33A is formed in the shape of a cylinder. The main body portion 33A includes a second shutter opening 33C. In other words, the second shutter 33 includes the second shutter opening 33C. The second shutter opening 33C is provided in the circumferential surface of the main body portion 33A. When the second shutter 33 is located in the open position, at least part of the second shutter opening 33C overlaps the reception port 32A. When the second shutter 33 is located in the close position, the second shutter opening 33C does not overlap the reception port 32A.

The second protrusion 33B is a protrusion which is in contact with the main body portion 19A (see FIG. 8) of the first shutter 19 when the developing cartridge 3 is being mounted on the drum cartridge 2. The second protrusion 33B protrudes from the circumferential surface of the main body portion 33A in a radial direction of the main body portion 33A.

As shown in FIG. 8, when the developing cartridge 3 is being mounted on the drum cartridge 2, if the protruding portion 32 of the waste-toner storage cartridge 31 is located between the other end portion 13B of the conveyance pipe 13 and the first guide 14A, the second protrusion 33B is in contact with the main body portion 19A of the first shutter 19. Here, the second shutter opening 33C overlaps the first shutter opening 19C. In other words, in a state where the second protrusion 33B is in contact with the first shutter 19, the first shutter opening 19C and the second shutter opening 33C overlap each other. The second shutter 33 has a shape which fits the shape of the first shutter 19 in a state where the second shutter opening 33C and the first shutter opening 19C overlap each other.

Then, as shown in FIG. 9, when the developing cartridge 3 is being mounted on the drum cartridge 2, in a state where the second shutter 33 is in contact with part of the drum cartridge 2, the second shutter 33 moves from the close position to the open position. Specifically, when the developing cartridge 3 is being mounted on the drum cartridge 2, in a state where the second protrusion 33B is in contact with the main body portion 19A of the first shutter 19, the second shutter 33 moves from the close position to the open position. When the developing cartridge 3 is being mounted on the drum cartridge 2, in a state where the second shutter 33 is in contact with the part of the drum cartridge 2, the protruding portion 32 is guided by the guide portion 14, and thereby the second shutter 33 moves from the close position to the open position. Specifically, when the developing cartridge 3 is being mounted on the drum cartridge 2, the protruding portion 32 and the main body portion 33A are guided by the second guide 14B in a direction toward the photosensitive drum 4 in the second direction. Then, in a state where the second protrusion 33B is in contact with the main body portion 19A of the first shutter 19, the main body portion 33A moves relative to the main body portion 19A of the first shutter 19, and thereby the second shutter 33 moves from the close position to the open position. In this way, in a state where the developing cartridge 3 is mounted on the drum cartridge 2, the second shutter 33 is located in the open position. In a state where the developing cartridge 3 is mounted on the drum cartridge 2, all of the discharge port 13C, the first shutter opening 19C, the second shutter opening 33C, and the reception port 32A overlap each other, such that toner conveyed through the conveyance pipe 13 is discharged from the discharge port 13C and received through the reception port 32A. In a state where the developing cartridge 3 is mounted on the drum cartridge 2, the protruding portion 32 is located between the other end portion 13B of the conveyance pipe 13 and the guide portion 14 in the third direction. In a state where the developing cartridge 3 is mounted on the drum cartridge 2, the protruding portion 32 is located between the other end portion 13B of the conveyance pipe 13 and the connection wall 2C in the third direction.

3.1.2 Auger

As shown in FIGS. 6 and 7, the auger 36 is located within the protruding portion 32 and within the waste-toner storage cartridge 31. The auger 36 is configured to convey the toner. The auger 36 extends in the first direction. When the process cartridge 1 is mounted on the image forming apparatus 100 (see FIG. 1), and an image forming operation is performed, the auger 36 is rotated to covey the toner within the protruding portion 32 toward the waste-toner storage cartridge 31.

3.1.3 Handle

The handle 34 is located on an opposite side from the toner storage chamber 7 with respect to the waste-toner storage cartridge 31 in the second direction. The handle 34 is part of the waste-toner storage cartridge 31. The handle 34 includes a contact portion 34A. The contact portion 34A extends in the first direction. The contact portion 34A is formed in the shape of a cylinder. As shown in FIG. 2, the contact portion 34A is a portion which is in contact with the first contact portion 16 of the drum cartridge 2 in a state where the developing cartridge 3 is mounted on the drum cartridge 2. Specifically, in a state where the developing cartridge 3 is mounted on the drum cartridge 2, the contact portion 34A is located closer to the toner storage chamber 7 than the first contact portion 16 is in the second direction. In a state where the developing cartridge 3 is mounted on the drum cartridge 2, the contact portion 34A is in contact with the first contact portion 16 in the second direction.

3.2 Mounting of Developing Cartridge on Drum Cartridge

The mounting of the developing cartridge 3 on the drum cartridge 2 will be described with reference to FIGS. 8 and 9.

As shown in FIG. 8, when the developing cartridge 3 is being mounted on the drum cartridge 2, the shaft 5A of the developing roller 5 first makes contact with the roller guide portion 15 between the one end portion 15A and the other end portion 15B. Then, the protruding portion 32 of the waste-toner storage cartridge 31 is located between the other end portion 13B of the conveyance pipe 13 and the first guide 14A.

Here, the protruding portion 32 of the waste-toner storage cartridge 31 is guided by the first guide 14A in a direction toward the connection wall 2C in the third direction, and thereby the protruding portion 32 is located between the other end portion 13B of the conveyance pipe 13 and the first guide 14A. Here, the first protrusion 19B of the first shutter 19 makes contact with the main body portion 33A of the second shutter 33, and the second protrusion 33B of the second shutter 33 makes contact with the main body portion 19A of the first shutter 19. The first shutter opening 19C overlaps the second shutter opening 33C.

Then, as shown in FIGS. 8 and 9, the protruding portion 32 of the waste-toner storage cartridge 31 is guided by the second guide 14B in a direction toward the photosensitive drum 4 in the second direction while the protruding portion 32 turns its direction from a direction toward the connection wall 2C in the third direction to a direction toward the photosensitive drum 4 in the second direction.

Here, in a state where the first shutter opening 19C and the second shutter opening 33C overlap each other, the first shutter 19 moves from the close position toward the open position, and the second shutter 33 moves from the close position toward the open position. In other words, the first shutter 19 and the second shutter 33 simultaneously move from the close position toward the open position in the state where the first shutter opening 19C and the second shutter opening 33C overlap each other.

Here, the shaft 5A of the developing roller 5 is guided by the roller guide portion 15 in a direction toward the photosensitive drum 4 in the second direction.

Then, as shown in FIG. 9, when the developing roller 5 makes contact with the photosensitive drum 4, the developing cartridge 3 stops the movement in a direction toward the photosensitive drum 4 in the second direction.

Thereafter, when the waste-toner storage cartridge 31 makes contact with the second contact portion 17, and the contact portion 34A of the handle 34 makes contact with the first contact portion 16, the waste-toner storage cartridge 31 is positioned with respect to the drum cartridge 2.

In this way, the mounting of the developing cartridge 3 on the drum cartridge 2 is completed.

When the developing cartridge 3 is separated from the drum cartridge 2, the contact between the contact portion 34A of the handle 34 and the first contact portion 16 is first released.

Then, as shown in FIGS. 8 and 9, the protruding portion 32 of the waste-toner storage cartridge 31 turns its direction from a direction away from the photosensitive drum 4 in the second direction to a direction away from the connection wall 2C in the third direction while being guided by the second guide 14B in a direction away from the photosensitive drum 4 in the second direction. Here, the shaft 5A of the developing roller 5 is guided by the roller guide portion 15 in a direction away from the photosensitive drum 4 in the second direction. In this way, the developing roller 5 is separated from the photosensitive drum 4. Here, in the state where the first shutter opening 19C and the second shutter opening 33C overlap each other, the first shutter 19 moves from the open position toward the close position, and the second shutter 33 moves from the open position toward the close position. In other words, in the state where the first shutter opening 19C and the second shutter opening 33C overlap each other, the first shutter 19 and the second shutter 33 simultaneously move from the open position toward the close position.

Thereafter, when the developing cartridge 3 is pulled out of the drum cartridge 2, the separation of the developing cartridge 3 from the drum cartridge 2 is completed.

As shown in FIG. 8, when the developing cartridge 3 is pulled out of the drum cartridge 2, the protruding portion 32 of the waste-toner storage cartridge 31 is guided by the first guide 14A in a direction away from the connection wall 2C in the third direction.

4. Operations and Effects

As shown in FIGS. 3 and 9, the process cartridge 1 stores the toner removed by the cleaner 12 from the circumferential surface of the photosensitive drum 4 through the conveyance pipe 13 in the waste-toner storage cartridge 31 of the developing cartridge 3.

Hence, even when the process cartridge 1 includes the waste-toner storage cartridge 31, and a space near the photosensitive drum 4 is restricted, the space near the developing cartridge 3 is utilized. The waste-toner storage cartridge 31 is coupled to the developing cartridge 3, and the waste-toner storage cartridge 31 is replaced together with the developing cartridge 3. Thus, the capacity of the developing cartridge 3 is increased without excessively increasing the capacity of the waste-toner storage cartridge 31.

As shown in FIGS. 8 and 9, when the developing cartridge 3 is being mounted on the drum cartridge 2, the protruding portion 32 of the waste-toner storage cartridge 31 is guided by the first guide 14A in the third direction which is different from the second direction directed toward the photosensitive drum 4 from the developing roller 5, and is thereafter guided by the second guide 14B toward the photosensitive drum 4 in the second direction.

In this way, in the configuration in which the waste-toner storage cartridge 31 is provided in the developing cartridge 3, the developing cartridge 3 can be smoothly mounted on the drum cartridge 2 by utilizing the protruding portion 32 of the waste-toner storage cartridge 31.

Here, the protruding portion 32 enters between the other end portion 13B and the connection wall 2C such that the protruding portion 32 moves around the other end portion 13B of the conveyance pipe 13. Hence, the reception port 32A is located below the discharge port 13C so as to communicate with the discharge port 13C. Hence, the waste toner moves by gravity from the discharge port 13C to the reception port 32A.

Second Embodiment

A process cartridge 40 of the second embodiment will be described with reference to FIGS. 10 to 15. In the process cartridge 40, the same members as in the process cartridge 1 are identified with the same reference numerals, and the description thereof will be omitted.

Figure 10:
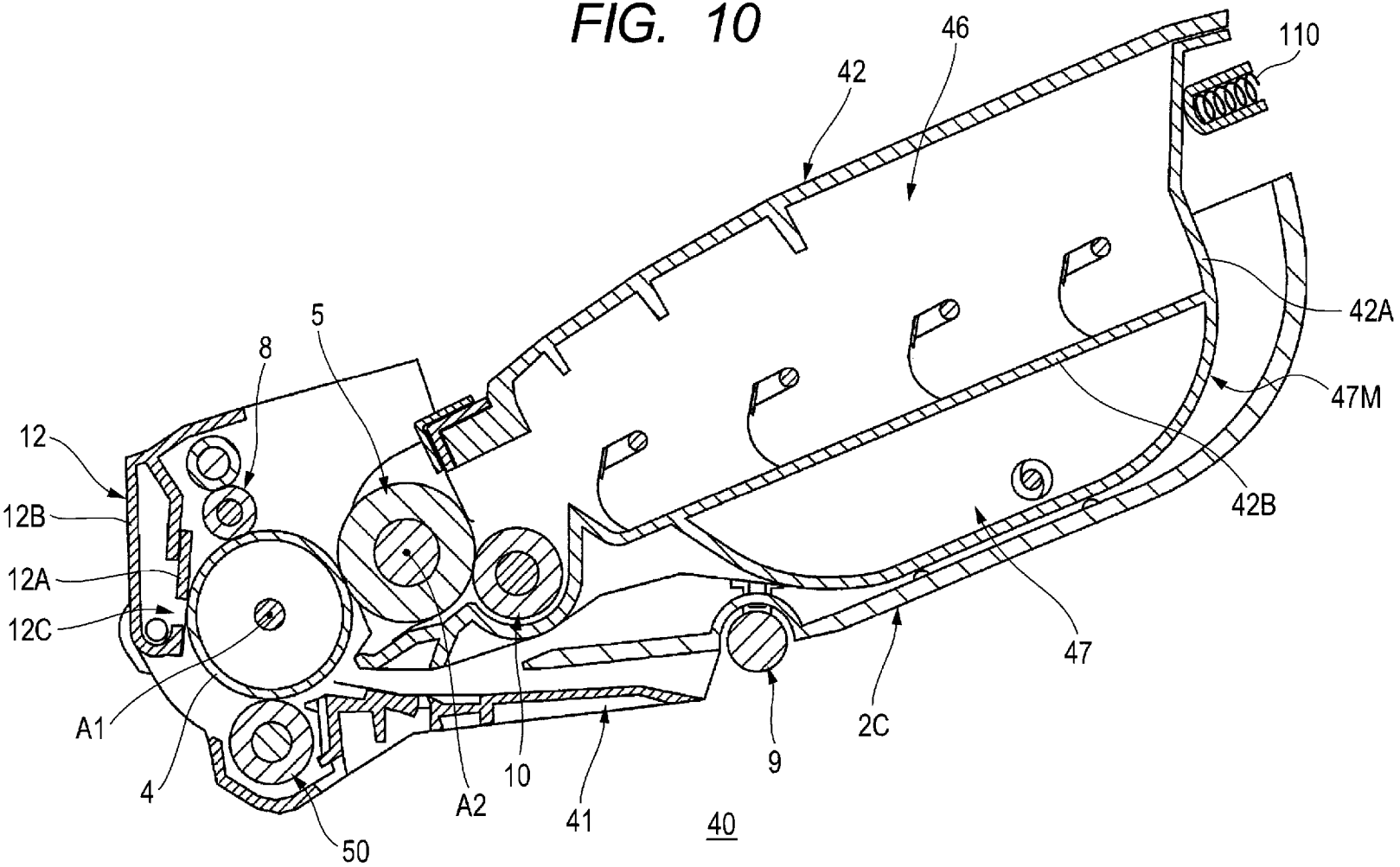
FIG. 10 is a schematic configuration diagram of a process cartridge of a second embodiment.

As shown in FIG. 10, the process cartridge 40 includes a drum cartridge 41 and a developing cartridge 42. The developing cartridge 42 is detachably mounted on the drum cartridge 41.

1. Drum Cartridge

Figure 11:
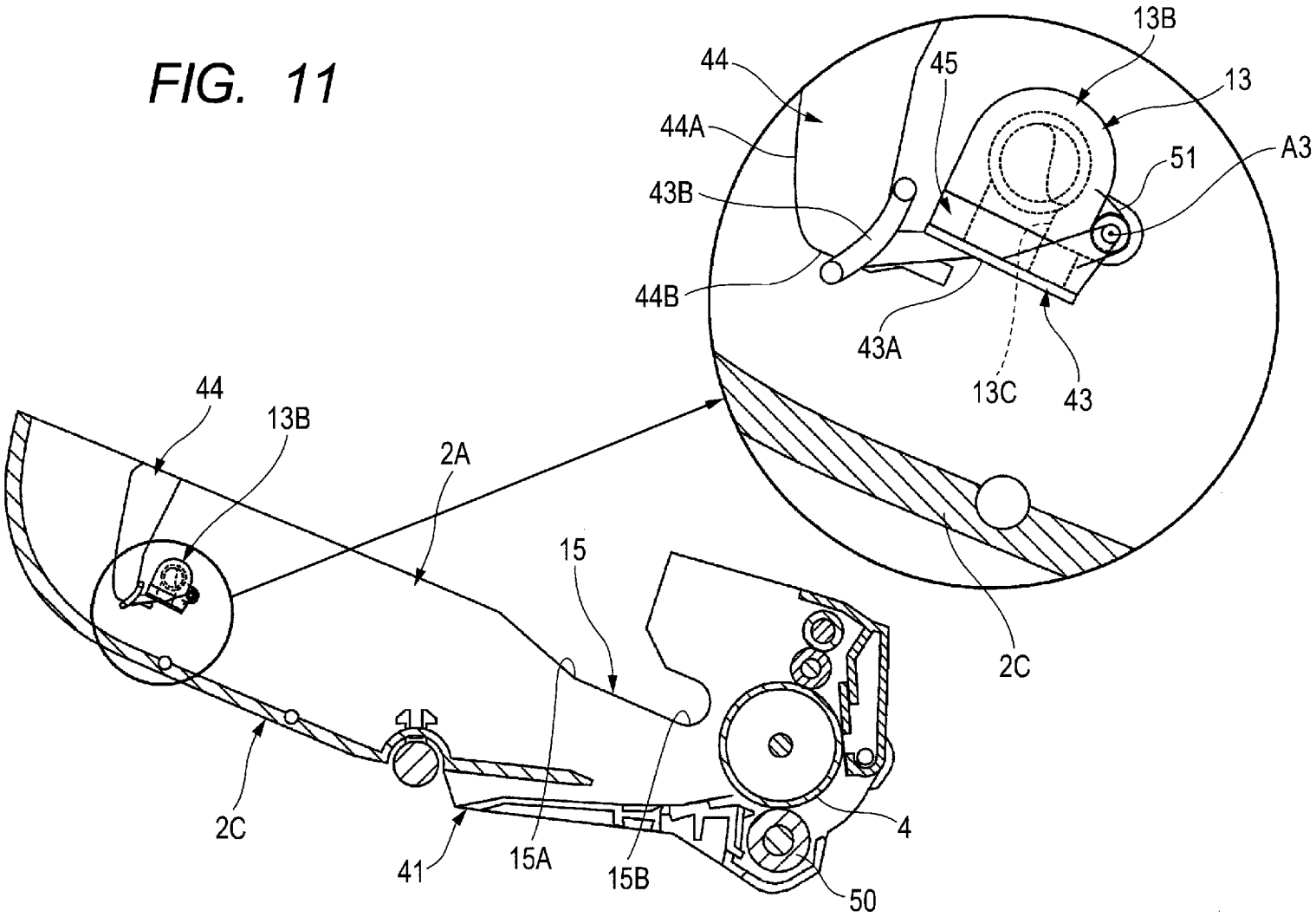
FIG. 11 is an illustrative diagram for illustrating a drum cartridge shown in FIG. 10, and for illustrating the other end portion of a conveyance pipe, a guide portion and a roller guide portion.

As shown in FIG. 11, the drum cartridge 41 includes a first shutter 43, a spring 51, a guide portion 44 and a transfer roller 50. The transfer roller 50 is configured to transfer the toner image formed on the circumferential surface of the photosensitive drum 4 to the sheet. The transfer roller 50 is in contact with the circumferential surface of the photosensitive drum 4.

1.1 First Shutter and Spring

The first shutter 43 can be moved between a close position (see FIG. 11) which closes the discharge port 13C and an open position (see FIG. 15) which opens the discharge port 13C. The first shutter 43 can be pivotally moved about a pivotal axis A3 between the close position and the open position. The pivotal axis A3 is located on an opposite side from the guide portion 44 with respect to the discharge port 13C in the second direction. The pivotal axis A3 is located between the discharge port 13C and the photosensitive drum 4 in the second direction. The first shutter 43 includes a cover portion 43A and a first protruding portion 43B. The pivotal axis A3 is an imaginary axis. More specifically, the pivotal axis A3 is an imaginary axis which extends along the direction in which the photosensitive drum 4 extends.

The cover portion 43A is a portion which covers the discharge port 13C when the first shutter 43 is located in the close position. The cover portion 43A covers the discharge port 13C so as to close the discharge port 13C. In the second embodiment, the conveyance pipe 13 includes a seal member 45. The seal member 45 is located on the circumferential surface of the conveyance pipe 13. The seal member 45 surrounds the discharge port 13C. The seal member 45 is in contact with the circumferential surface of the conveyance pipe 13. The seal member 45 is fixed to the circumferential surface with an adhesive or the like. The cover portion 43A extends along the seal member 45. The cover portion 43A is formed in the shape of a plate. The cover portion 43A makes contact with the seal member 45 when the first shutter 43 is located in the close position.

Figure 13:
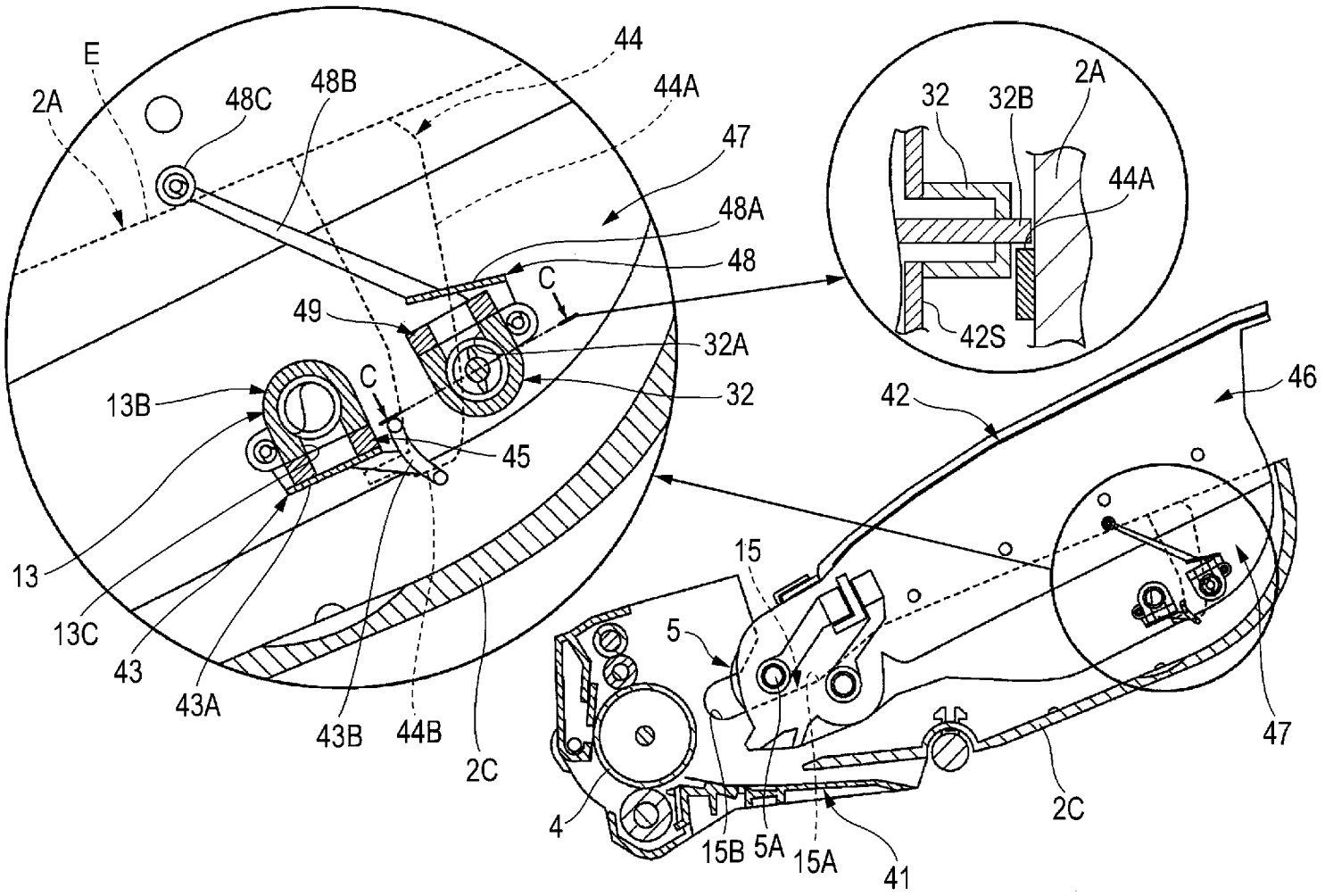
FIG. 13 is an illustrative diagram for illustrating the mounting of the developing cartridge on the drum cartridge in the second embodiment, and shows a state where a protruding portion of a waste-toner storage portion is guided by a first guide and also shows a cross-sectional view of the protruding portion taken along line C-C.

The first protruding portion 43B is a portion contacted by the protruding portion 32 (see FIGS. 14 and 15) of the developing cartridge 42 when the developing cartridge 42 is being mounted on the drum cartridge 41. The protruding portion 32 protrudes from a side surface (outer surface) 42S of the developing cartridge 42 (FIG. 13). The side surface 42S is a side surface of a waste-toner storage chamber 47 described later. The first protruding portion 43B protrudes from the cover portion 43A. The first protruding portion 43B is located on an opposite side from the pivotal axis A3 with respect to the cover portion 43A.

The spring 51 is a helical torsion spring which is provided around the pivotal axis A3. The spring 51 urges the first shutter 43 toward the close position by the elastic force of the spring 51.

Figure 15:
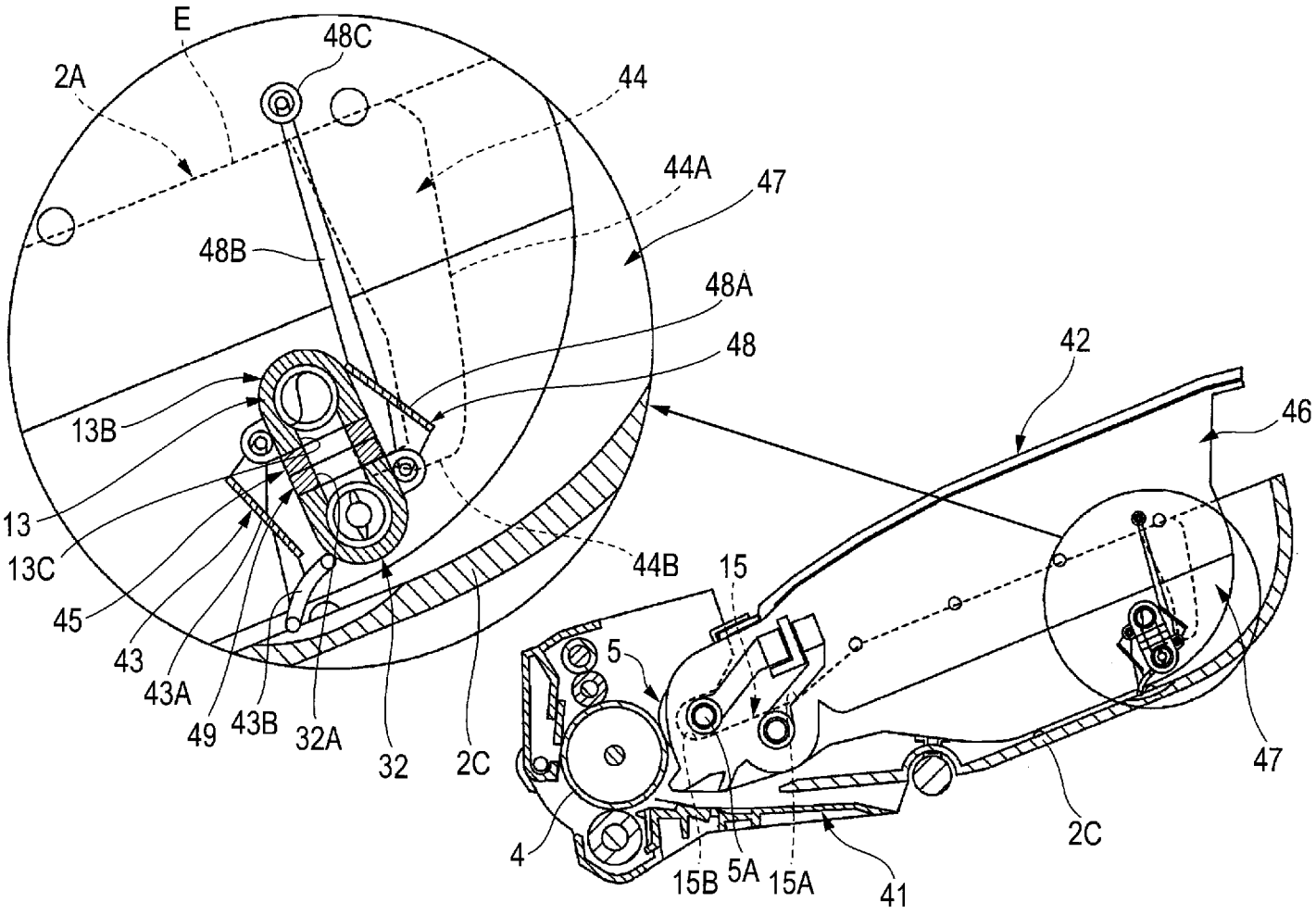
FIG. 15 is an illustrative diagram for illustrating the mounting of the developing cartridge on the drum cartridge following FIG. 14, and shows a state where the mounting of the developing cartridge on the drum cartridge is completed.

As shown in FIG. 15, when the developing cartridge 42 is being mounted on the drum cartridge 41, in a state where the first shutter 43 is in contact with part of the developing cartridge 42, the first shutter 43 moves from the close position to the open position. When the developing cartridge 42 is being mounted on the drum cartridge 41, in the state where the first shutter 43 is in contact with the part of the developing cartridge 42, the protruding portion 32 is guided by the guide portion 44, and thereby the first shutter 43 moves from the close position to the open position. Specifically, as shown in FIG. 13, the protruding portion 32 of the waste-toner storage chamber 47 of the developing cartridge 42 includes a protruding portion 32B which further protrudes from the protruding portion 32. When the developing cartridge 42 is being mounted on the drum cartridge 41, the protruding portion 32B is guided by a second guide 44B described later in a direction toward the photosensitive drum 4 in the second direction. Then, the first protruding portion 43B is pressed by the protruding portion 32, and thereby the first shutter 43 moves from the close position to the open position. The first shutter 43 is located in the open position in a state where the developing cartridge 42 is mounted on the drum cartridge 41.

1.2 Guide Portion

As shown in FIG. 11, the guide portion 44 is a portion for guiding the protruding portion 32B (see FIG. 13) when the developing cartridge 42 is being mounted on the drum cartridge 41. The guide portion 44 is located on the inner surface of the first wall 2A. The guide portion 44 protrudes from the inner surface of the first wall 2A. The guide portion 44 includes a first guide 44A and a second guide 44B.

The first guide 44A is an end surface of the guide portion 44 in the second direction. The first guide 44A is located on an opposite side from the photosensitive drum 4 with respect to the conveyance pipe 13 in the second direction. The first guide 44A extends in the third direction.

The second guide 44B is an end surface of the guide portion 44 in the third direction. The second guide 44B is located between the first guide 44A and the connection wall 2C in the third direction. The second guide 44B is located closer to the photosensitive drum 4 than the first guide 44A is in the second direction. The second guide extends linearly in the second direction.

Figure 14:
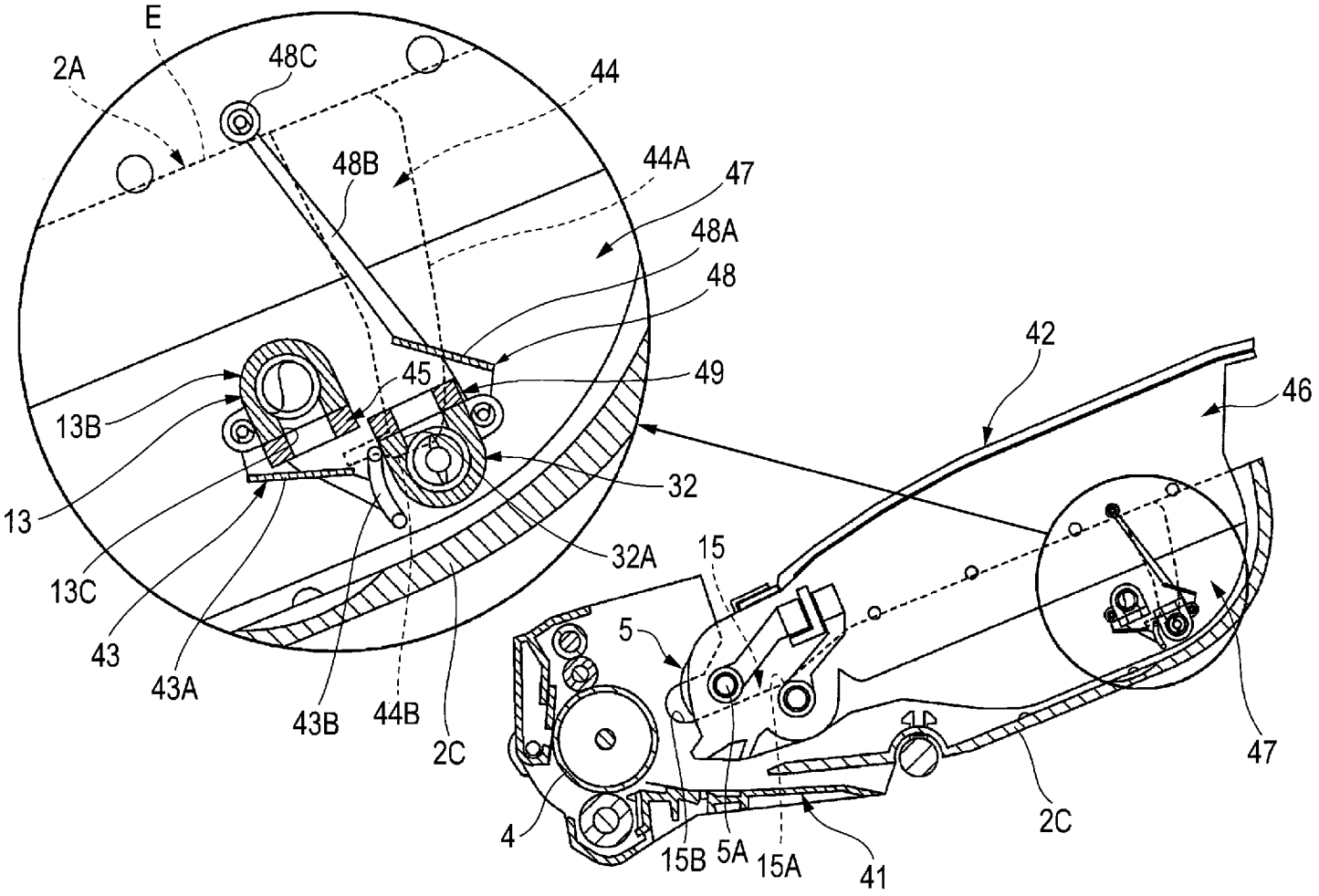
FIG. 14 is an illustrative diagram for illustrating the mounting of the developing cartridge on the drum cartridge following FIG. 13, and shows a state where the protruding portion of the waste-toner storage portion is guided by a second guide.

In this way, as shown in FIGS. 13 and 14, when the developing cartridge 42 is being mounted on the drum cartridge 41, the protruding portion 32 of the waste-toner storage chamber 47 of the developing cartridge 42 is guided by the first guide 44A in a direction toward the connection wall 2C in the third direction, and is then guided by the second guide 44B in a direction toward the photosensitive drum 4 in the second direction.

2. Developing Cartridge

Figure 12:
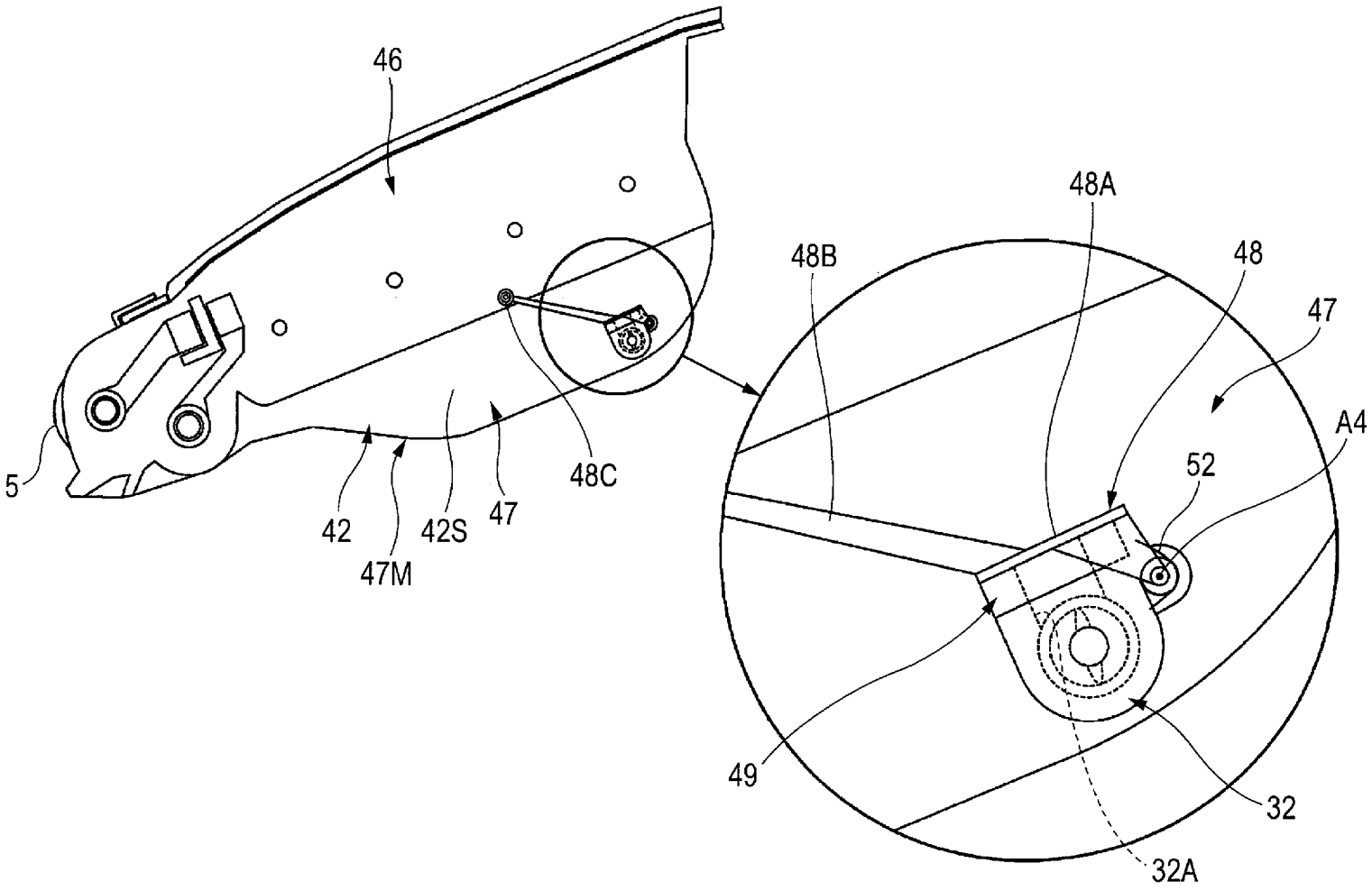
FIG. 12 is a side view of a developing cartridge shown in FIG. 10.

As shown in FIGS. 10 and 12, the developing cartridge 42 integrally includes a toner storage chamber 46 and the waste-toner storage chamber 47. The developing cartridge 42 includes a casing 42A and a wall 42B. The wall 42B partitions a space in the casing 42A into the toner storage chamber 46 and the waste-toner storage chamber 47. The casing 42A and the wall 42B defining the waste-toner storage chamber 47 serve as a main portion 47M (FIGS. 10 and 12) of a waste-toner storage portion. The protruding portion 32 protrudes from the main portion 47M in the first direction. The main portion 47M and the protruding portion 32 are an example of the waste-toner storage portion. In a state where the developing cartridge 42 is mounted on the drum cartridge 41, the waste-toner storage chamber 47 is located between the toner storage chamber 46 and the connection wall 2C in the third direction. The developing cartridge 42 includes a second shutter 48 and a spring 52 (see FIG. 12).

The developing cartridge 42 is urged in the second direction by a spring 110 provided in the image forming apparatus 100. For example, the spring 110 is provided at the cover 104 (see FIG. 1) of the image forming apparatus 100.

2.1 Second Shutter and Spring

The second shutter 48 can be moved between a close position (see FIG. 12) which closes the reception port 32A and an open position (see FIG. 15) which opens the reception port 32A. As shown in FIG. 12, the second shutter 48 can be pivotally moved about a pivotal axis A4 between the close position and the open position. The pivotal axis A4 is located on an opposite side from the developing roller 5 with respect to the reception port 32A in the second direction. The second shutter 48 includes a cover portion 48A and a second protruding portion 48B. The pivotal axis A4 is an imaginary axis. More specifically, the pivotal axis A4 is an imaginary axis which extends along the direction in which the photosensitive drum 4 extends.

The cover portion 48A is a portion which covers the reception port 32A when the second shutter 48 is located in the close position. The cover portion 48A covers the reception port 32A so as to close the reception port 32A. In the second embodiment, the protruding portion 32 includes a seal member 49. The seal member 49 is located on the circumferential surface of the protruding portion 32. The seal member 49 surrounds the reception port 32A. The seal member 49 makes contact with the circumferential surface of the protruding portion 32. The seal member 49 is fixed to the circumferential surface of the protruding portion 32 with an adhesive or the like. The cover portion 48A extends along the seal member 49. The cover portion 48A is formed in the shape of a plate. The cover portion 48A makes contact with the seal member 49 when the second shutter 48 is located in the close position.

The second protruding portion 48B is a portion which is in contact with an edge E (see FIGS. 13 and 14) of the first wall 2A when the developing cartridge 42 is being mounted on the drum cartridge 41. The second protruding portion 48B protrudes from the cover portion 48A. The second protruding portion 48B is located on an opposite side from the pivotal axis A4 with respect to the cover portion 48A. The second protruding portion 48B includes a roller 48C. The roller 48C is located at the tip end of the second protruding portion 48B. The roller 48C extends in the first direction. The roller 48C is rotatable about an axis which extends in the first direction.

The spring 52 is a helical torsion spring which is provided around the pivotal axis A4. The spring 52 urges the second shutter 48 toward the close position by the elastic force of the spring 52.

As shown in FIG. 13, when the developing cartridge 42 is being mounted on the drum cartridge 41, the roller 48C of the second protruding portion 48B is in contact with the edge E of the first wall 2A.

Then, as shown in FIGS. 13 and 14, when the developing cartridge 42 is being mounted on the drum cartridge 41, in a state where the second shutter 48 is in contact with part of the drum cartridge 41, the second shutter 48 moves from the close position to the open position. When the developing cartridge 42 is being mounted on the drum cartridge 41, in the state where the second shutter 48 is in contact with the part of the drum cartridge 41, the protruding portion 32 is guided by the guide portion 44, and thereby the second shutter 48 moves from the close position to the open position.

Specifically, as shown in FIG. 13, when the developing cartridge 42 is being mounted on the drum cartridge 41, the protruding portion 32 is guided by the first guide 44A in a direction toward the connection wall 2C in the third direction. Then, in a state where the roller 48C is in contact with the edge E of the first wall 2A, the protruding portion 32 moves in a direction toward the connection wall 2C in the third direction. In this way, the second shutter 48 moves from the close position to the open position.

Then, as shown in FIG. 14, the protruding portion 32 is guided by the second guide 44B in a direction toward the photosensitive drum 4 in the second direction. Then, in the state where the roller 48C is in contact with the edge E of the first wall 2A, the protruding portion 32 moves in a direction toward the photosensitive drum 4 in the second direction. In this way, the second shutter 48 is further moved from the close position toward the open position. The second shutter 48 is located in the open position in a state where the developing cartridge 42 is mounted on the drum cartridge 41. In a state where the developing cartridge 42 is mounted on the drum cartridge 41, the protruding portion 32 is located between the other end portion 13B of the conveyance pipe 13 and the connection wall 2C in the third direction.

2.2 Mounting of Developing Cartridge on Drum Cartridge

The mounting of the developing cartridge 42 on the drum cartridge 41 will be described with reference to FIGS. 13 to 15.

As shown in FIG. 13, when the developing cartridge 42 is being mounted on the drum cartridge 41, the shaft 5A of the developing roller 5 first makes contact with the roller guide portion 15 between the one end portion 15A and the other end portion 15B. Then, in the state where the roller 48C is in contact with the edge E of the first wall 2A, the protruding portion 32 of the waste-toner storage chamber 47 of the developing cartridge 42 is guided by the first guide 44A in a direction toward the connection wall 2C in the third direction. In this way, the second shutter 48 moves from the close position to the open position. Here, the protruding portion 32 of the waste-toner storage chamber 47 of the developing cartridge 42 is not in contact with the first protruding portion 43B of the first shutter 43, and the first shutter 43 is located in the close position.

Then, as shown in FIG. 14, in the state where the roller 48C is in contact with the edge E of the first wall 2A, the protruding portion 32 of the waste-toner storage chamber 47 of the developing cartridge 42 is guided by the second guide 44B in a direction toward the photosensitive drum 4 in the second direction. In this way, the second shutter 48 is further moved from the close position toward the open position. The protruding portion 32 of the waste-toner storage chamber 47 of the developing cartridge 42 makes contact with the first protruding portion 43B of the first shutter 43, and the first shutter 43 moves from the close position to the open position. Here, the shaft 5A of the developing roller 5 is guided by the roller guide portion 15 in a direction toward the photosensitive drum 4 in the second direction.

Then, as shown in FIG. 15, when the developing roller 5 makes contact with the photosensitive drum 4, the developing cartridge 42 stops the movement in a direction toward the photosensitive drum 4 in the second direction. Here, the protruding portion 32 of the waste-toner storage chamber 47 of the developing cartridge 42 is located between the other end portion 13B of the conveyance pipe 13 and the connection wall 2C in the third direction. The reception port 32A faces the discharge port 13C in the third direction. Thereafter, the seal member 45 and the seal member 49 make contact with each other. In this way, the reception port 32A overlaps the discharge port 13C. In other words, the reception port 32A and the discharge port 13C communicate with each other.

In this way, the mounting of the developing cartridge 42 on the drum cartridge 41 is completed. A contact surface between the seal member 45 and the seal member 49 is in the second direction. Hence, even when the developing cartridge 3 is vibrated in the second direction, the seal member 45 and the seal member 49 are elastically deformed, and thereby the communication of the reception port 32A with the discharge port 13C is maintained.

As shown in FIG. 14, when the developing cartridge 42 is separated from the drum cartridge 41, the protruding portion 32 of the waste-toner storage cartridge 31 is guided by the second guide 44B in a direction away from the photosensitive drum 4 in the second direction. Here, the shaft 5A of the developing roller 5 is guided by the roller guide portion 15 in a direction away from the photosensitive drum 4 in the second direction. In this way, the developing roller 5 separates from the photosensitive drum 4. The first shutter 43 moves from the open position to the close position by the elastic force of the spring 51, and the second shutter 48 moves from the open position to the close position by the elastic force of the spring 52.

Thereafter, as shown in FIG. 13, the protruding portion 32 of the developing cartridge 42 around the waste-toner storage cartridge 31 is guided by the first guide 44A in a direction away from the connection wall 2C in the third direction. Here, the protruding portion 32 of the developing cartridge 42 around the waste-toner storage chamber 47 separates from the first protruding portion 43B of the first shutter 43, and the first shutter 43 is located in the close position.

Thereafter, when the developing cartridge 3 is pulled out of the drum cartridge 2, the separation of the developing cartridge 3 from the drum cartridge 2 is completed. Here, the roller 48C separates from the edge E of the first wall 2A, and the second shutter 48 is located in the close position.

In the second embodiment, the same operations and effects as in the first embodiment described above are obtained.

Modification

While the disclosure has been described in detail with reference to the above aspects thereof, it would be apparent to those skilled in the art that various changes and modifications may be made therein without departing from the scope of the claims.

For example, in a state where the developing cartridge 3 is mounted on the drum cartridge 2, the developing roller 5 may be adjacent to the photosensitive drum 4 with a space therebetween. In this case, the developing roller 5 is located in a developing position adjacent to the photosensitive drum 4 by using an appropriate spacer. In a state where the developing roller 5 is located in the developing position, the toner is conveyed from the developing roller 5 to the photosensitive drum 4 by electrostatic force.

What is claimed is:

1. A process cartridge detachably attachable to an image forming apparatus, comprising:

a drum cartridge comprising:

a photosensitive drum extending in a first direction;

a cleaner for removing waste toner from the photosensitive drum;

a first wall having a guide portion;

a second wall spaced apart along the first direction from the first wall; and a conveyance pipe for conveying waste toner, the conveyance pipe extending in a second direction below the guide portion as viewed from the first direction; and a developing cartridge detachably attached to the drum cartridge at an attaching position between the first wall and the second wall, the developing cartridge comprising:

a developing roller comprising a shaft, the shaft being guided toward the attaching position by the guide portion when the developing cartridge is attached to the drum cartridge; and a waste toner storage cartridge for storing waste toner, wherein an end of the conveyance pipe has a first port and a first shutter configured to open and close the first port;

wherein the waste toner storage cartridge has a second port and a second shutter configured to open and close the second port; and wherein, when the developing cartridge is attached to the drum cartridge, the first port and the second port are coupled to each other.

2. The process cartridge according to claim 1, wherein, when the developing cartridge is detached from the drum cartridge, the developing cartridge is guided by the guide portion.

3. The process cartridge according to claim 1, wherein the developing cartridge comprises a boss extending along the first direction; and wherein, when the developing cartridge is attached to the drum cartridge, the boss is guided by the guide portion.

4. The process cartridge according to claim 1, wherein, when the developing cartridge is attached to the drum cartridge, the developing roller is movable with respect to the photosensitive drum.

5. The process cartridge according to claim 1, wherein the second direction is a direction in which the developing roller and the photosensitive drum are aligned.

6. The process cartridge according to claim 1, wherein the conveyance pipe extends along the guide portion as viewed from the first direction.

7. A drum cartridge comprising:

a photosensitive drum extending in a first direction;

a cleaner for removing waste toner from the photosensitive drum;

a first wall having a guide portion configured to guide a shaft of a developing roller of a developing cartridge when the developing cartridge is attached to the drum cartridge; and a conveyance pipe for conveying waste toner, the conveyance pipe extending in a second direction below the guide portion as viewed from the first direction, wherein an end of the conveyance pipe has a first port and a first shutter configured to open and close the first port; and wherein, when the developing cartridge is attached to the drum cartridge, the first port is coupled to a second port of a waste toner storage cartridge of the developing cartridge.

8. The drum cartridge according to claim 7, wherein, when the developing cartridge is detached from the drum cartridge, the developing cartridge is guided by the guide portion.

9. The drum cartridge according to claim 7, wherein, when the developing cartridge is attached to the drum cartridge, the guide portion guides a boss of the developing cartridge, the boss extending along the first direction.

10. The drum cartridge according to claim 7, wherein, when the developing cartridge is attached to the drum cartridge, the developing roller is movable with respect to the photosensitive drum.

11. The drum cartridge according to claim 7, wherein the second direction is a direction in which the developing roller and the photosensitive drum are aligned.

12. The drum cartridge according to claim 7, wherein the conveyance pipe extends along the guide portion as viewed from the first direction.

13. A process cartridge detachably attachable to an image forming apparatus, comprising:

a drum cartridge comprising:

a photosensitive drum extending in a first direction;

a cleaner for removing waste toner from the photosensitive drum;

a first wall having a guide portion;

a second wall spaced apart along the first direction from the first wall; and a conveyance pipe for conveying waste toner, the conveyance pipe extending in a second direction below the guide portion as viewed from the first direction; and a developing cartridge detachably attached to the drum cartridge at an attaching position between the first wall and the second wall, the developing cartridge comprising:

a developing roller; and a waste toner storage cartridge for storing waste toner, wherein the guide portion is configured to guide the developing cartridge toward the attaching position when the developing cartridge is attached to the drum cartridge;

wherein an end of the conveyance pipe has a first port and a first shutter configured to open and close the first port;

wherein the waste toner storage cartridge has a second port and a second shutter configured to open and close the second port; and wherein, when the developing cartridge is attached to the drum cartridge, the first port and the second port are coupled to each other.

14. The process cartridge according to claim 13, wherein the developing roller comprises a shaft being guided toward the attaching position by the guide portion.

15. A drum cartridge comprising:

a photosensitive drum extending in a first direction;

a cleaner for removing waste toner from the photosensitive drum;

a first wall having a guide portion configured to guide a developing cartridge when the developing cartridge is attached to the drum cartridge; and a conveyance pipe for conveying waste toner, the conveyance pipe extending in a second direction below the guide portion as viewed from the first direction, wherein an end of the conveyance pipe has a first port and a first shutter configured to open and close the first port; and wherein, when the developing cartridge is attached to the drum cartridge, the first port is coupled to a second port of a waste toner storage cartridge of the developing cartridge.

16. The drum cartridge according to claim 15, wherein the guide portion is configured to guide a shaft of a developing roller of the developing cartridge when the developing cartridge is attached to the drum cartridge.

* * * * *